US010829919B2

(12) United States Patent
Blum

(10) Patent No.: US 10,829,919 B2
(45) Date of Patent: Nov. 10, 2020

(54) JET REGULATOR THAT CAN BE PIVOTED INTO A CLEANING POSITION

(71) Applicant: Neoperl GmbH, Mullheim (DE)

(72) Inventor: Gerhard Blum, Gutach (DE)

(73) Assignee: Neoperl GmbH, Müllheim (DE)

( * ) Notice: Subject to any disclaimer, the term of this patent is extended or adjusted under 35 U.S.C. 154(b) by 216 days.

(21) Appl. No.: 15/767,492

(22) PCT Filed: Aug. 23, 2016

(86) PCT No.: PCT/EP2016/001420

§ 371 (c)(1),
(2) Date: Apr. 11, 2018

(87) PCT Pub. No.: WO2017/076478

PCT Pub. Date: May 11, 2017

(65) Prior Publication Data

US 2018/0282986 A1 Oct. 4, 2018

(30) Foreign Application Priority Data

Nov. 5, 2015 (DE) ..... 20 2015 007 677 U

(51) Int. Cl.
*E03C 1/086* (2006.01)
*E03C 1/084* (2006.01)
*E03C 1/08* (2006.01)

(52) U.S. Cl.
CPC ..... *E03C 1/086* (2013.01); *E03C 1/084* (2013.01); *E03C 2001/082* (2013.01)

(58) Field of Classification Search
CPC . E03C 1/08; E03C 1/084; E03C 1/086; E03C 2001/082
See application file for complete search history.

(56) References Cited

U.S. PATENT DOCUMENTS 2,197,667 A * 4/1940 Shook ..... B05B 1/18 239/460
3,067,953 A * 12/1962 Aghnides ..... E03C 1/084 239/428.5

(Continued)

FOREIGN PATENT DOCUMENTS

CN 101287879 10/2008
CN 201809818 4/2011

(Continued)

*Primary Examiner* — Darren W Gorman
(74) *Attorney, Agent, or Firm* — Volpe Koenig

(57) ABSTRACT

A jet regulator (101) having a sleeve-shaped jet regulator housing (7) which is capable of being assembled on the water outlet of a sanitary outlet fitting, and having a wall (3) which supports a perforated structure (4) that forms the outlet end side of the jet regulator (101) and which in the jet regulator housing (7) is pivotable between a use position, in which the perforated structure (4) extends transversely across an outflow-side sleeve opening of the jet regulator housing (7), and a cleaning position, in which the water flowing through the jet regulator housing (7) can flow out of the jet regulator housing (7) on both sides of the wall (3) through opening gaps (8, 9) that are formed between the wall (3) and the neighboring housing internal circumferential wall. It is characteristic of the jet regulator (101) according to the invention that the wall (3) has a spherical-layer-shaped external circumference (5) and by way of said spherical-layer-shaped external circumference (5) is pivotably mounted in a joint socket (6) which is provided on the housing internal circumferential wall of the jet regulator housing (7).

27 Claims, 16 Drawing Sheets

(56) References Cited

U.S. PATENT DOCUMENTS

| | | | | |
|---|---|---|---|---|
| 4,351,727 | A * | 9/1982 | Brogger | B01D 35/043 137/550 |
| 4,457,030 | A | 7/1984 | Burry | |
| 8,006,922 | B2 | 8/2011 | Katzer | |
| 8,205,810 | B2 * | 6/2012 | Lacher | E03C 1/08 239/428.5 |
| 8,727,239 | B2 | 5/2014 | Weis et al. | |
| 9,382,700 | B2 | 7/2016 | Blum | |
| 9,840,834 | B2 * | 12/2017 | Blum | E03C 1/08 |
| 2007/0194154 | A1 * | 8/2007 | Katzer | E03C 1/08 239/589 |
| 2012/0228409 | A1 | 9/2012 | Lacher et al. | |
| 2014/0145014 | A1 * | 5/2014 | Blum | E03C 1/084 239/428.5 |
| 2016/0017580 | A1 | 1/2016 | Blum | |

FOREIGN PATENT DOCUMENTS

| | | |
|---|---|---|
| CN | 202139650 | 2/2012 |
| CN | 103806506 | 5/2014 |
| CN | 203701213 | 7/2014 |
| DE | 102004039915 | 10/2005 |
| DE | 102005010550 | 10/2006 |
| DE | 202013001994 | 7/2014 |
| WO | 2006092316 | 9/2006 |
| WO | 2011155572 | 12/2011 |
| WO | 2014142766 | 9/2014 |

* cited by examiner 101
25
7
3
5
38
11
12
18
19
4
6

101
25
3
37
10
11
12
19
4
18
6
7
5

25
23
7
3
24

101
23
38
3
37
10
24
12
4
19
7

101
17
11
12
18
4
24
23

101
24
23
6
9
12
3
5
5
8
19
4

JET REGULATOR THAT CAN BE PIVOTED INTO A CLEANING POSITION

BACKGROUND

The invention relates to a jet regulator having a sleeve-shaped jet regulator housing which is capable of being assembled on the water outlet of a sanitary outlet fitting, and having a wall which supports a perforated structure that forms the outlet end side of the jet regulator and which in the jet regulator housing is pivotable between a use position, in which the perforated structure extends transversely across an outflow-side housing opening of the jet regulator housing, and a cleaning position, in which the water flowing through the jet regulator housing can flow out of the jet regulator housing through at least one opening gap that is formed between the wall and the neighboring housing internal circumferential wall.

A jet regulator of the type mentioned at the outset has previously been known from WO 2014/142766 A1. The previously known jet regulator has a sleeve-shaped jet regulator housing which is capable of being assembled on the water outlet of a sanitary outlet fitting in order for the water flowing out therefrom to be shaped into a homogeneous and non-spraying water jet. An annular wall which supports a perforated structure that forms the outlet end side of the previously known jet regulator is provided in the jet regulator housing. This annular wall, on opposite sides of the external circumference thereof, has in each case one axle stump, said axle stumps being mounted on the internal circumference of the jet regulator housing. The annular wall is mounted in the jet regulator housing so as to be pivotable about said axle stumps in such a manner that the annular wall in the jet regulator housing is pivotable between a use position, in which the perforated structure extends transversely across an outflow-side sleeve opening of the jet regulator housing, and a cleaning position, in which the water flowing through the jet regulator housing can flow out of the jet regulator housing on both sides of the annular wall through opening gaps that are formed between the annular wall and the neighboring housing internal circumferential wall. In this way, chalk deposits or other dirt particles which are entrained in the water and have accumulated on the inflow side ahead of the perforated structure can be rinsed out and be conveyed out of the jet regulator housing through one of the opening gaps, so as to also ensure the continued flawless operation of the jet regulator. A pin which as a handling element is intended to facilitate the pivoting of the annular wall from the use position to the cleaning position and vice versa projects laterally on the annular wall. However, it is disadvantageous that this handling element in most of the relative positions of the jet regulator in the water outlet remains clearly visible and can animate many people to pivot the annular wall unnecessarily and to optionally also leave said annular wall in the cleaning position thereof. Moreover, a handling element that projects on the water outlet compromises the visual appearance of the entire sanitary outlet fitting.

A jet regulator having a jet regulator housing which on the housing external circumference thereof supports an external thread is already known from DE 10 2005 010 550 B4, the previously known jet regulator by way of said external thread being able to be screw-fitted in an internal thread in the water outlet of a sanitary outlet fitting. The previously known jet regulator has a spherical-layer-shaped articulated sleeve which is provided on the internal circumference side on the outflow-side end region of the jet regulator housing so as to be pivotable in a joint socket of a complementary shape. A perforated plate herein is provided in the interior of the sleeve of the pivotably mounted articulated sleeve. Since the articulated sleeve that has the perforated plate is pivotably mounted, the outlet direction of the exiting water jet can be changed and newly aligned when required. Since the articulated sleeve impacts components of the previously known jet regulator that are disposed upstream on the inflow side and also act as a pivot detent already at comparatively minor pivot angles, cleaning of the previously known jet regulator in the assembled state is neither possible nor envisaged.

SUMMARY

There is therefore in particular the object of achieving a jet regulator of the type mentioned at the outset, which can also be easily cleaned in the assembled state, wherein said jet regulator despite the easy handling, is not to substantially compromise the external appearance of a sanitary outlet fitting.

The achievement according to the invention of this object in the jet regulator of the type mentioned at the outset lies in particular in that the wall has a spherical-layer-shaped external circumference and by way of this spherical-layer-shaped external circumference is pivotably mounted in a joint socket which is provided on the housing internal circumferential wall of the jet regulator housing.

The jet regulator according to the invention has a sleeve-shaped jet regulator housing which is capable of being assembled on the water outlet of a sanitary outlet fitting. The jet regulator according to the invention has a wall which is, for example, configured as an articulated or pivoting sleeve and preferably as an annular wall, which has a spherical-layer-shaped external circumference. This wall which supports a perforated structure that forms the outlet end side of the jet regulator, by way of the spherical-layer-shaped external circumference of said wall is pivotably mounted in a joint socket which is provided on the housing internal circumferential wall of the jet regulator housing. The wall, by way of the spherical-layer-shaped external circumference thereof, is mounted in the joint socket so as to be pivotable in such a manner that said wall in the jet regulator housing is pivotable between a use position, in which the perforated structure extends transversely across an outflow-side housing opening of the jet regulator housing, and a cleaning position, in which the water flowing through the jet regulator housing can flow out of the jet regulator housing through at least one opening gap that is formed between the wall and the neighboring housing internal circumferential wall. Since no axle stumps which establish the pivot axis of said wall in the jet regulator housing are provided on the wall of the jet regulator according to the invention, the wall can also be rotated in the circumferential direction in the joint socket, so as to potentially rotate distracting details such as, for example, a projecting handling element, out of the field of view of the observer. Since the wall in each rotational position can be pivoted in an arbitrary manner between the use position and the at least one cleaning position, the simple handling of the jet regulator according to the invention is additionally further facilitated.

An easy and pressure-free pivotability of the wall in the joint socket is additionally further facilitated when the joint socket in at least one part-region has a shape that is complementary to that of the spherical-layer-shaped wall.

It is particularly advantageous for the wall to be mounted so as to be rotatable in the circumferential direction and so as to be pivotable in the joint socket in each rotational position.

In order for the user to identify the cleaning function and cleaning possibility as easily as possible, it is expedient for a handling element which preferably projects beyond the circumference or the outflow end side of the jet regulator housing to be provided on the wall. The user can therefore engage on the handling element in order for the wall to be subsequently pivoted in the jet regulator housing. The user herein can control the pivoting procedure also from a distance above the sanitary outlet fitting, without said user having to lower his/her face to the level of the water outlet.

A particularly simple embodiment according to the invention provides that the handling element is designed so as to be pin-shaped.

In order for the wall not to pivot in a self-acting manner under the pressure of the inflowing water, it is advantageous for the wall in the use position to be securable on the jet regulator housing preferably by a latching connection.

Such a latching connection can have, for example, at least one protruding latching protrusion on the handling element, which is capable of being latched in an encircling latching groove on the housing external circumference of the jet regulator housing or in at least one concave latching molding that that is provided on the outflow-side housing end periphery of the jet regulator housing. In particular an encircling latching groove on the housing external circumference, which is capable of being latched by way of a latching protrusion on the handling element, permits the wall to be latched practically in each rotational position in such a manner that even a handling element that projects beyond the water outlet is outside the field of view of the user.

However, it is also possible for the handling element to be capable of being latched on the outflow-side housing end side of the jet regulator housing. To this end, at least one latching receptacle in which the handling element is capable of being latched can be provided on the outflow-side housing end side.

It is a particular advantage of the solution according to the invention, that the jet regulator according to the invention can also be configured as an aerated jet regulator, the water flowing through being mixed with ambient air in the jet regulator housing of said jet regulator. When the jet regulator according to the invention is configured as an aerated jet regulator, a homogeneous, non-spraying and pearly soft water jet can be shaped in the jet regulator according to the invention.

A preferred embodiment according to the invention herein provides that the jet regulator has a jet splitter which splits the water flowing through into a multiplicity of individual jets. In order for the dirt particles that accumulate on the inflow side of said jet splitter to be removed, it is advantageous for the jet splitter to be held in the wall.

In order for such dirt particles to be unable to settle in the splitter openings of the jet splitter, it is advantageous for the jet splitter on the inflow side to be connected to an attachment or filter screen. A preferred embodiment according to the invention herein provides that the jet splitter supports the inflow-side attachment or filter screen, and that the attachment or filter screen is preferably configured so as to be hat-shaped or dish-shaped. An attachment or filter screen that in particular is configured so as to be hat-shaped or dish-shaped can be designed such that said attachment or filter screen remains still in the envelope circle formed or described by the pivotable wall.

The jet splitter can be configured, for example, as a perforated plate which has a plurality of splitter openings.

However, in order for the inflowing water to be able to be sufficiently decelerated and effectively split already across a minor distance, it is advantageous for the jet splitter to be configured as a pot-shaped diffuser which on the pot circumference of the pot shape thereof has splitter openings, the pot base of said pot-shaped diffuser forming an impact face which deflects the inflowing water toward the splitter openings.

In order for the water that in the form of individual jets flows through the jet splitter to be subsequently able to suction the required ambient air, it is advantageous for the splitter openings to open into an annular gap which tapers in the flow direction. Since the annular gap tapers in the flow direction, the individual jets that emanate from the splitter openings and flow into the annular gap are accelerated in such a manner that a vacuum is created according to Bernoulli's equation on the outflow side of the annular gap. On account of this vacuum that is formed on the outflow side of the annular gap, ambient air can be suctioned into the housing interior of the jet regulator housing, said ambient air therein being mixed with the water flowing through.

An embodiment according to the invention which is producible in a particularly simple manner herein provides that the annular gap is provided between the diffuser and a diffuser ring that encompasses the diffuser.

A preferred refinement according to the invention provides that the wall in the outflow-side part-region thereof has at least one aerating duct that is open at the end side and is optionally also configured as an annular gap, and that the inner wall portion that delimits the annular gap forms an interior wall which has at least one aerating opening, and/or onto which the perforated structure is preferably integrally molded. The wall, in the outflow-side part-region thereof, has at least one aerating duct that is open at the end side. Ambient air in the aerating duct which subsequently by way of the at least one aerating opening reaches the housing interior of the jet regulator according to the invention can be suctioned in through the duct opening that is oriented toward the outflow side. It is expedient herein for the perforated structure to be preferably integrally molded onto the internal wall that delimits the aerating duct, so as to restrict the mobility and the number of the component parts of the jet regulator according to the invention.

In order for the jet regulator according to the invention to be able to withstand also high water pressures, it is advantageous for the wall to be able to be insertable into the jet regulator housing from the inflow side of the latter.

In order for the water that flows through the jet regulator according to the invention to flow through the perforated structure in the wall and thus for undesirable leakage flows that bypass said perforated structure to be able to be avoided, it is advantageous for a seal, preferably configured as an annular seal, which seals between the wall and the housing internal circumference of the jet regulator housing to be provided in the inflow-side part-region of the joint socket.

In order for the seal to be fixed in the jet regulator housing, on the one hand, and to hinder the wall from being undesirably squeezed out of the jet regulator housing, on the other hand, it is advantageous for a holding ring to be provided, said holding ring being capable of being latched on the housing internal circumference of the jet regulator housing, on the one hand, and securing the seal on the housing internal circumference of the jet regulator housing, on the other hand.

In contrast, another preferred embodiment according to the invention provides that at least in regions an elastic coating or layer is provided between the wall and the part-region of the jet regulator housing that serves as a joint socket, said coating or layer sealing between these component parts of the jet regulator that are pivotable relative to one another.

This elastically sealing layer or coating herein can be provided on that part-region of the jet regulator housing that serves as a joint socket. However, an embodiment in which the wall on the external circumference thereof, at least in regions, supports the encircling elastic layer or coating is preferred.

In order for the production of the jet regulator according to the invention to be simplified, it is advantageous for the housing part of the jet regulator housing that supports the layer or the coating, or the wall that supports said layer or coating, to be produced as a multi-component plastics injection molded part.

One embodiment according to the invention provides that the jet regulator housing on the housing external circumference thereof has an annular shoulder or an annular flange, and that the jet regulator is insertable into a sleeve-shaped outlet mouthpiece that is capable of being assembled on the water outlet of a sanitary outlet fitting, until the annular shoulder or the annular flange impacts or bears on a contact face in the outlet mouthpiece.

According to another proposal according to the invention, it is provided that the jet regulator housing on the housing external circumference thereof supports an external thread, the jet regulator housing by way of said external thread being screw-fittable on or in an internal thread in the water outlet of the sanitary outlet fitting.

In order to be able to clean the jet regulator according to the invention in a simple manner at temporal intervals, it is advantageous for the water flowing through the jet regulator housing in the cleaning position to be able to preferably selectively flow out of the jet regulator through an opening gap that is formed on one side on the wall, or through opening gaps that are formed on both sides of the wall.

It is a particular advantage of the jet regulator according to the invention that the spherical-layer-shaped wall on the external circumference thereof is pivotably mounted in a joint socket without axle stumps having to be provided externally on this wall. In order for the wall in the use position thereof to now be moved to a position that is oriented so as to be almost perpendicular to the jet regulator longitudinal axis, it is advantageous for at least one alignment protrusion which in the use position of the wall bears on the outflow side of the jet regulator housing to project on the outflow end side of the wall. An undesirable tilted position of the wall in the use position is avoided due to this at least one alignment protrusion, said tilted position otherwise potentially leading to a likewise undesirable inclined outflow of the outflowing water.

The handling of the jet regulator according to the invention and the alignment of the wall thereof in the use position herein is substantially facilitated when at least two alignment protrusions project on the wall, said alignment protrusions being disposed on both sides of the handling element and preferably at equal spacings from the handling element on the outflow end side of the wall.

In order for the water consumption to be able to be restricted in an advantageous manner with the aid of the jet regulator according to the invention, it is advantageous for the jet regulator on the inflow-side end side thereof to be preferably releasably connected to a flow regulator, said flow regulator, independently of the pressure, regulating the water volume that flows through the jet regulator to an established maximum value per unit of time. It is avoided with the aid of this flow regulator that the water volume that flows through the jet regulator according to the invention in the use position of the wall exceeds an established maximum value when the water pressure of the inflowing water is continuously increased.

In the case of an embodiment of the jet regulator according to the invention having an attachment or filter screen that is disposed upstream on the inflow side, it is advantageous for the attachment screen to be in particular releasably held on the flow regulator, and the flow regulator to be in particular releasably held on the jet regulator. In this preferred embodiment, the unit formed from the jet regulator, the flow regulator and also the attachment screen on the inflow side can be pivoted with the aid of the wall that is pivotably mounted in the jet regulator housing.

It is established in many countries that the water volume that flows out of the water outlet of a sanitary outlet fitting per unit of time must not exceed a legally established limit value. In the case of an embodiment in which the jet regulator according to the invention carries the flow regulator, said flow regulator cannot fulfil the function thereof in the open position of the wall. However, in order for the legal parameters to be able to be met also in the open position of the wall of the jet regulator according to the invention, one embodiment according to the invention provides that optionally also an additional flow regulator which, independently of the pressure, regulates the water volume flowing through to a potential maximum value per unit of time that is also legally established is provided in the inflow line to the jet regulator, preferably so as to be spaced apart from said jet regulator in the flow direction.

Refinements according to the invention are derived from the description in conjunction with the claims, and from the drawing. The invention will be described in yet more detail hereunder by preferred exemplary embodiments. In the figures:

FIG. 1 shows a longitudinally sectioned jet regulator having a jet regulator housing which in the housing interior thereof has a wall which supports an outflow-side perforated structure and which by way of the spherical-layer-shaped external circumference thereof is mounted in a joint socket so as to be pivotable in such a manner that the wall is pivotable between a use position and a cleaning position;

Figure 54:
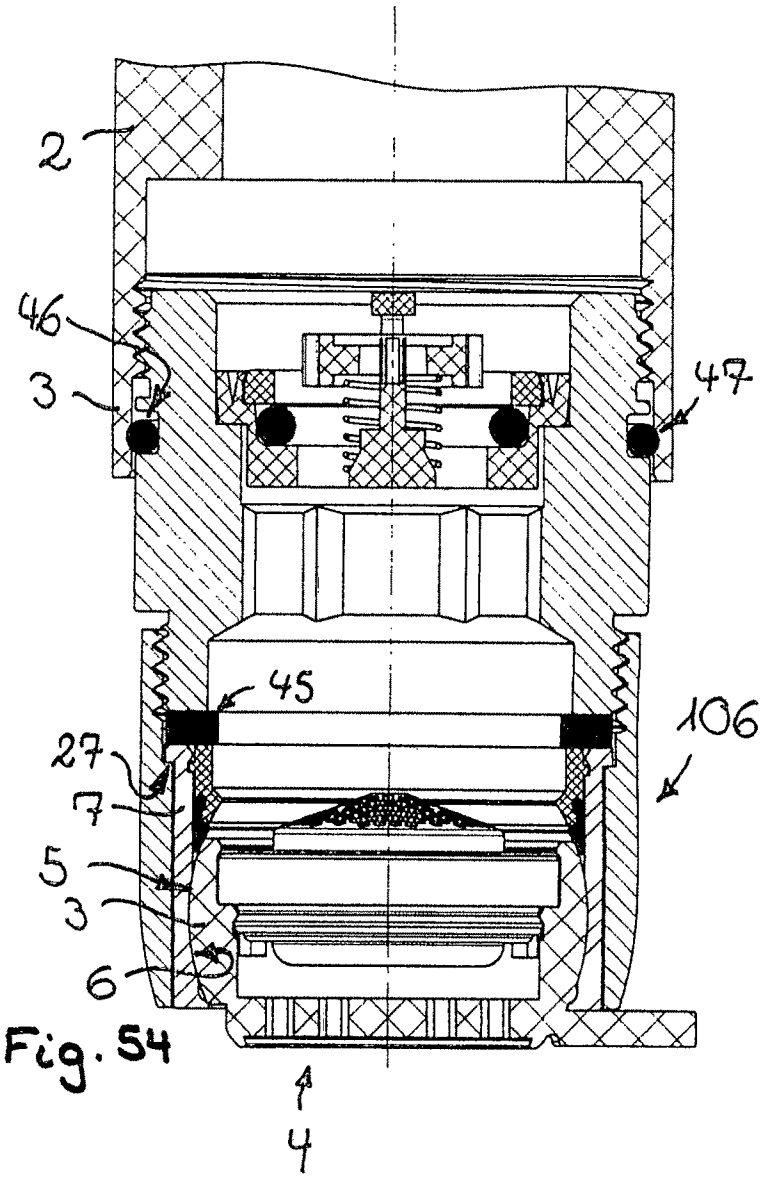
Figure 53:
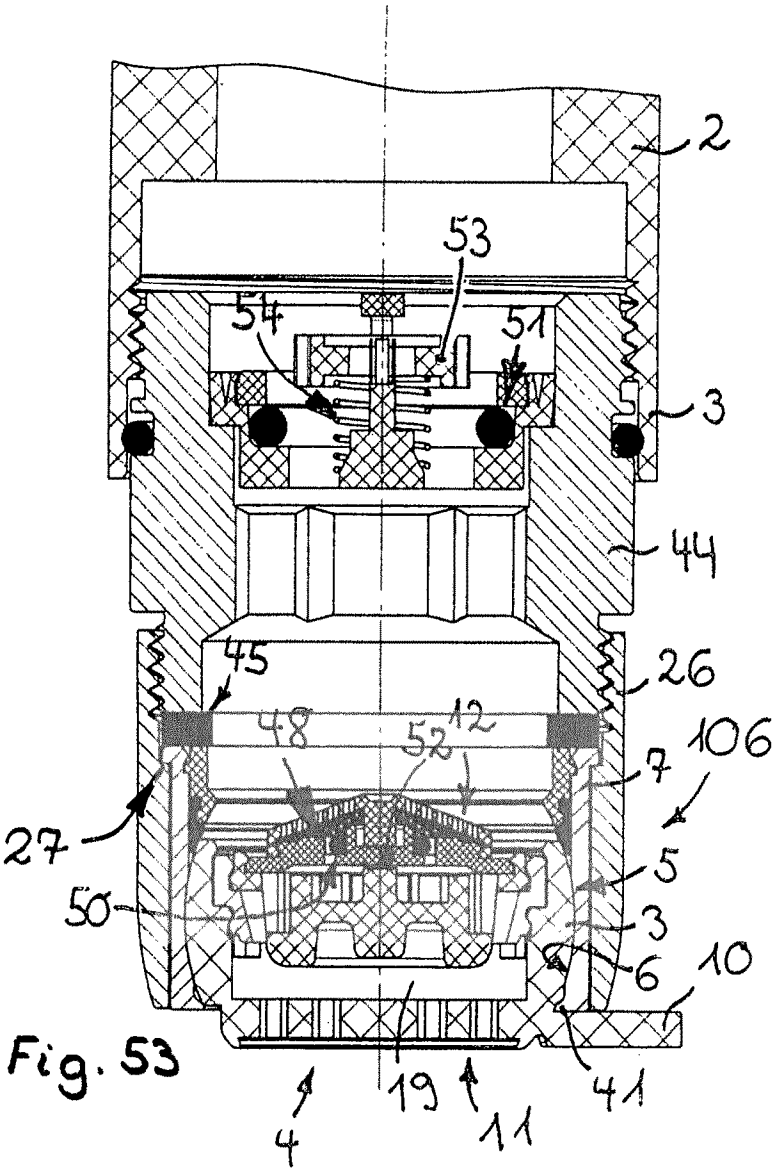
Figure 56:
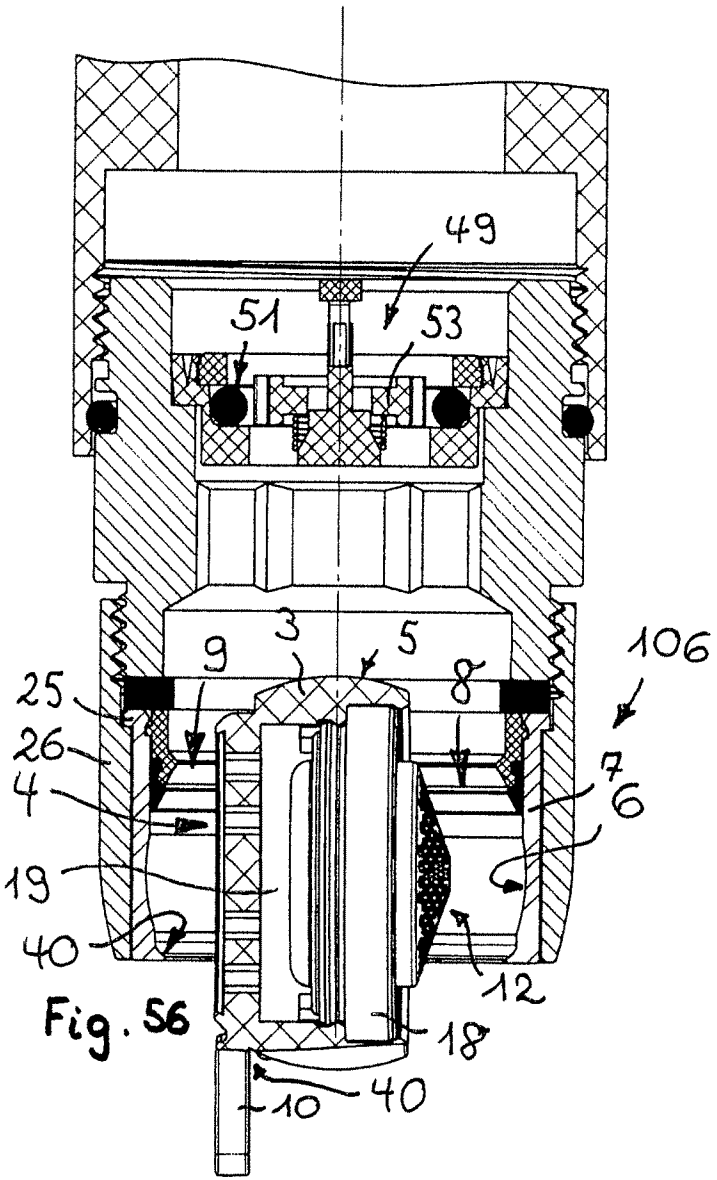
Figure 55:
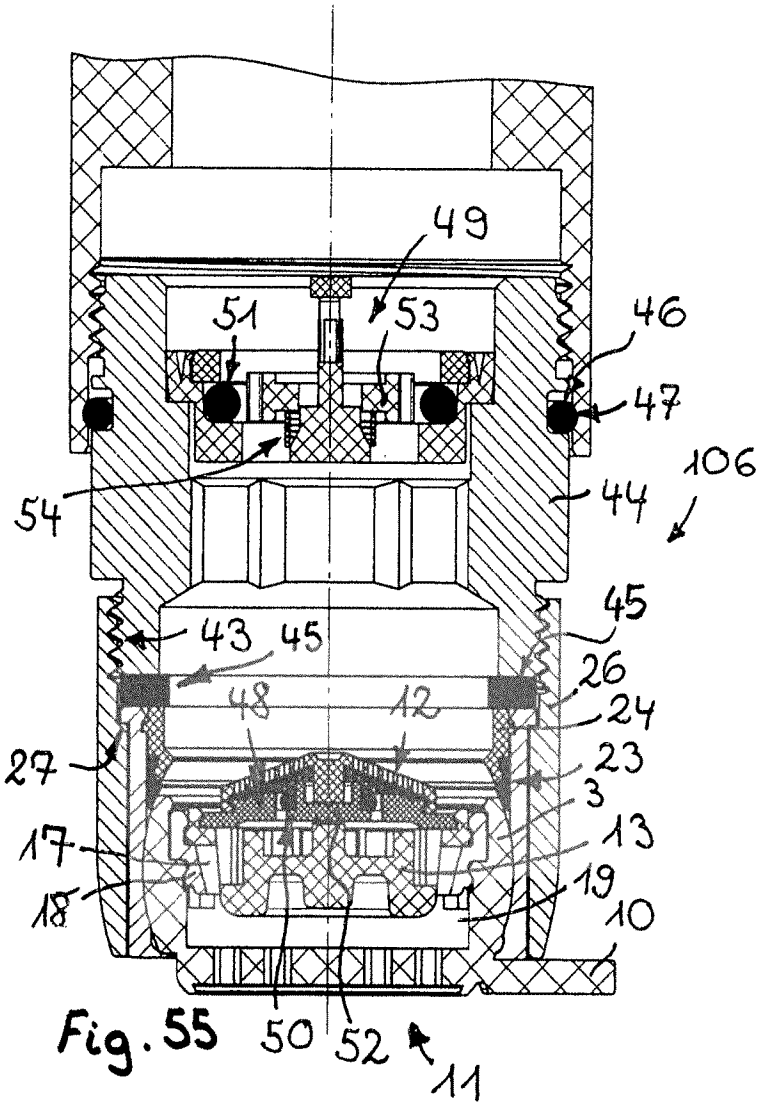
Figure 57:
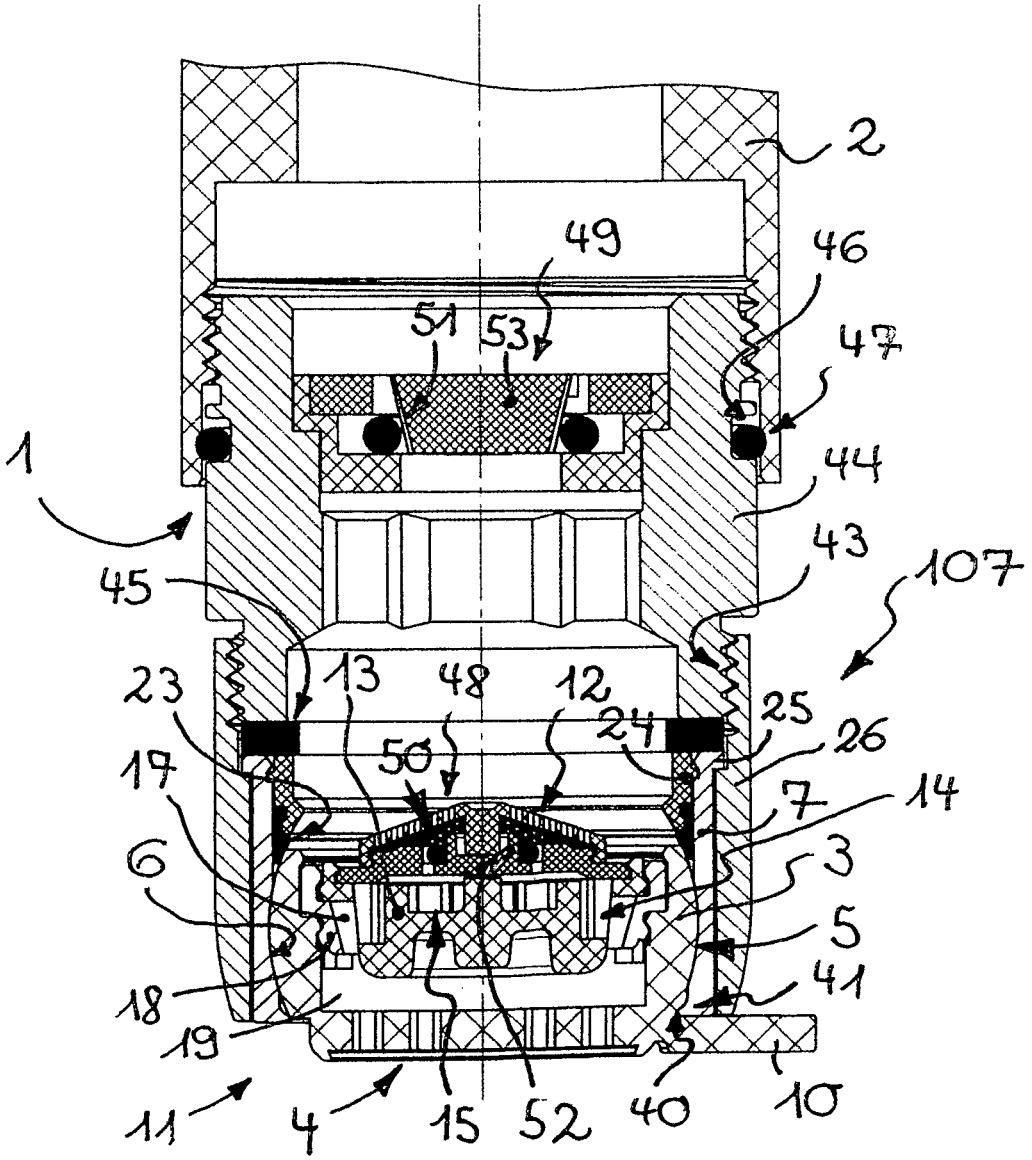

FIG. 53 shows a further longitudinally sectioned embodiment of a jet regulator which is held in an outlet mouthpiece which by way of an adapter is fastenable to the water outlet of a sanitary outlet fitting, wherein the jet regulator on the inflow side thereof is connected to a flow regulator which in turn supports an attachment or filter screen, and wherein a further additional flow regulator is interposed in the part-region of the inflow-side upstream waterline that is configured as an adapter, so as to be spaced apart from the jet regulator;

FIG. 54 shows the exemplary embodiment already illustrated in FIG. 53, in a further longitudinal section, wherein the jet regulator here in regions has not been longitudinally sectioned;

FIG. 55 shows the exemplary embodiment from FIGS. 53 and 54 in a longitudinal section, wherein a regulator core that is disposed in the flow regulator and is guided so as to be displaceable in the longitudinal direction, here is located in the regulating position of said regulator core;

FIG. 56 shows the exemplary embodiment from FIGS. 53 to 55 in the open position of the wall that is pivotable in the jet regulator housing; and FIG. 57 shows a variant of embodiment that is designed so as to be comparable to the exemplary embodiment according to FIGS. 53 to 56, said variant of embodiment however in the adapter having a flow regulator that already regulates at low pressures with a regulating gap of such size that dirt particles can also pass through said regulating gap.

DETAILED DESCRIPTION OF THE PREFERRED EMBODIMENTS

Figures 1, 2, 3, 4, 5, 6:
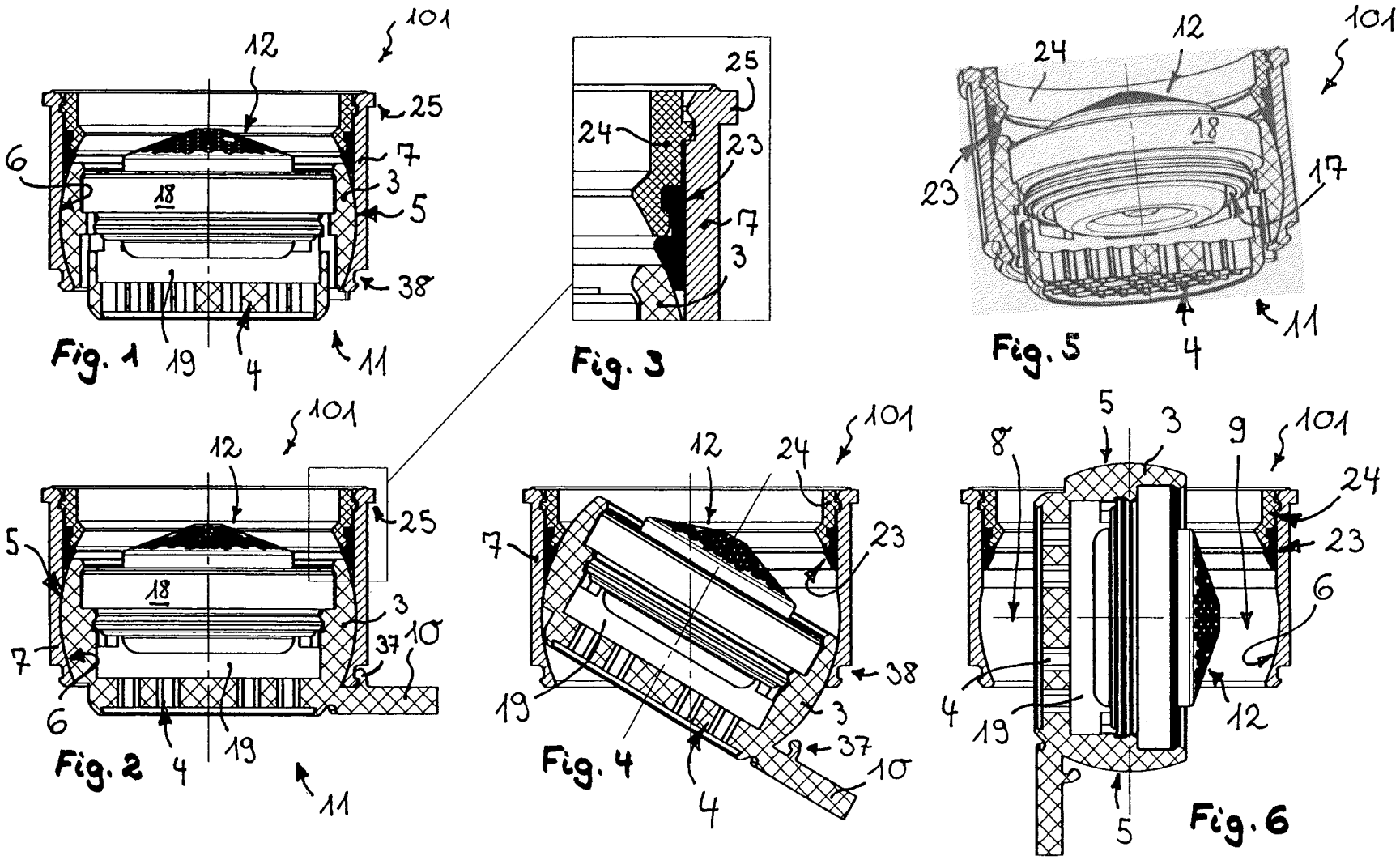
FIG. 2 shows the jet regulator from FIG. 1 in a rotated longitudinal section, this now also allowing a pin-shaped handling element that is molded onto the wall and projects laterally beyond the jet regulator housing to be seen.
FIG. 3 shows the jet regulator from FIGS. 1 and 2 in a detailed longitudinal section in the part-region framed in FIG. 2 in the region of a holding ring which is capable of being latched on the housing internal circumference of the jet regulator housing, on the one hand, and secures a seal which seals between the wall and the housing internal circumference, on the other hand.
FIG. 4 shows the wall in the likewise longitudinally sectioned jet regulator housing, in the pivoted position between the use position and the cleaning position.
FIG. 5 shows the jet regulator from FIGS. 1 to 4 in a perspective longitudinal section.
FIG. 6 shows the jet regulator from FIGS. 1 to 5 in the cleaning position of the wall of said jet regulator.
Figure 8:
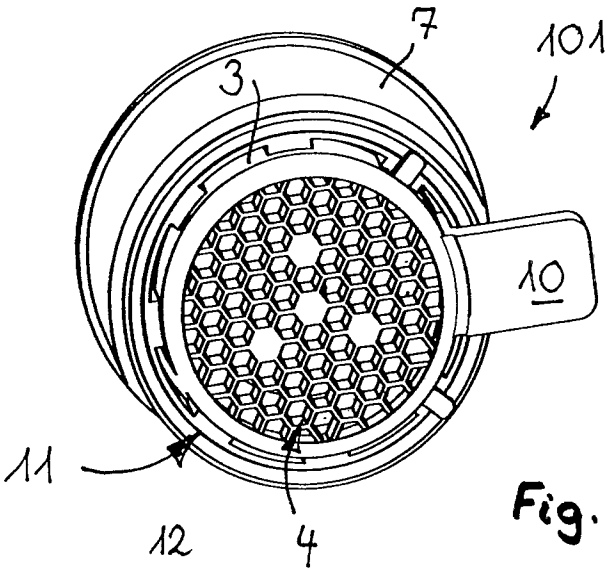
FIG. 8 shows the jet regulator from FIGS. 1 to 7 in a perspective plan view of the perforated structure of said jet regulator that forms the outlet end side of the jet regulator.
Figure 9:
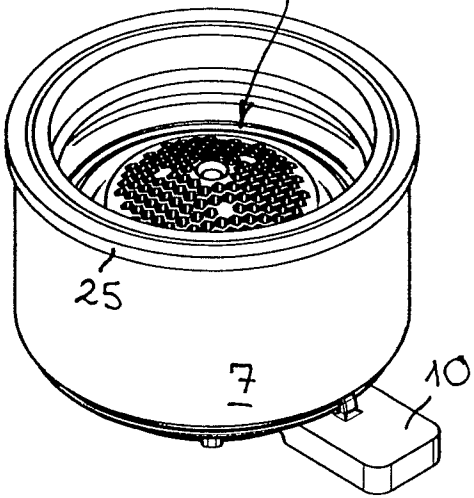
FIG. 9 shows the jet regulator from FIGS. 1 to 8 in a plan view of the inflow side of the jet regulator housing.
Figure 7:
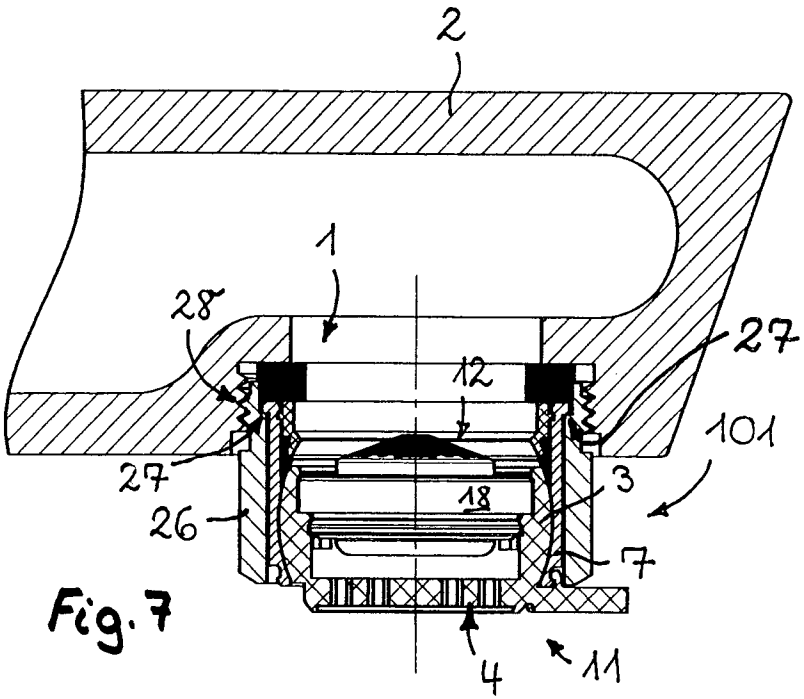
FIG. 7 shows the jet regulator shown in FIGS. 1 to 6, said jet regulator here being assembled on the water outlet of a sanitary outlet fitting.
Figure 10:
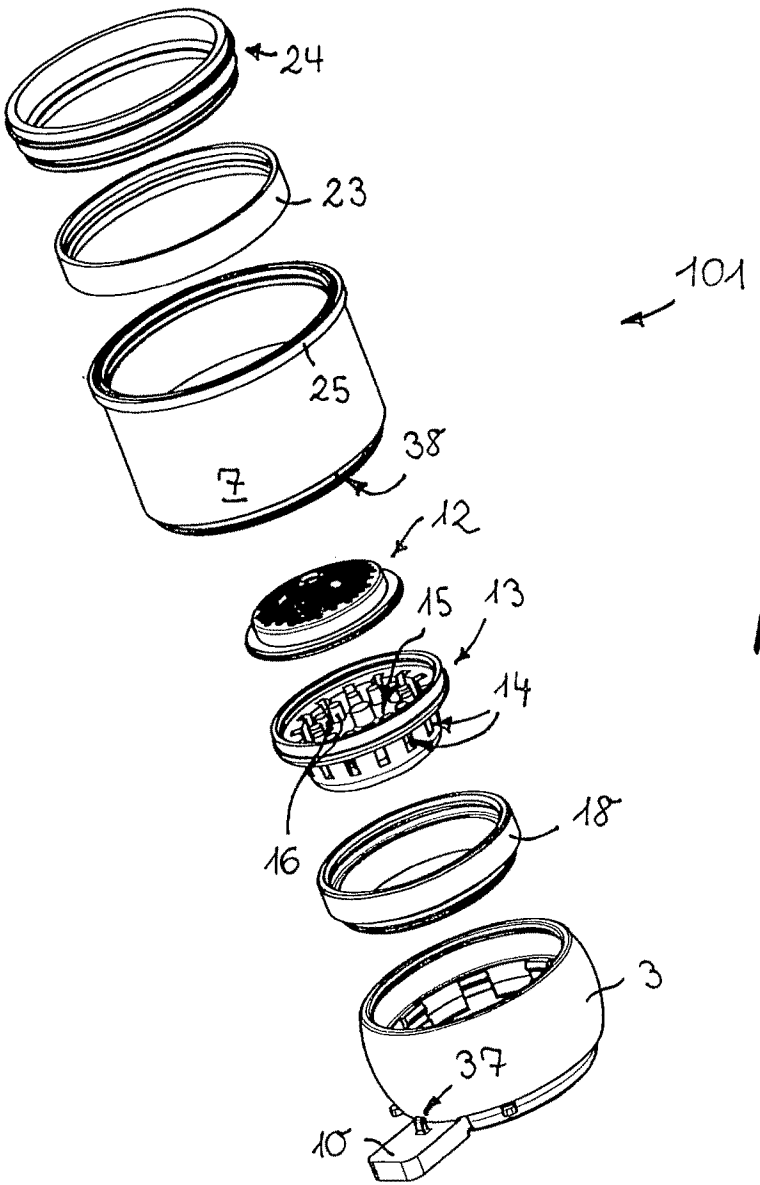
FIG. 10 shows the jet regulator from FIGS. 1 to 9 in an exploded perspective illustration of the component parts of said jet regulator.
Figure 11:
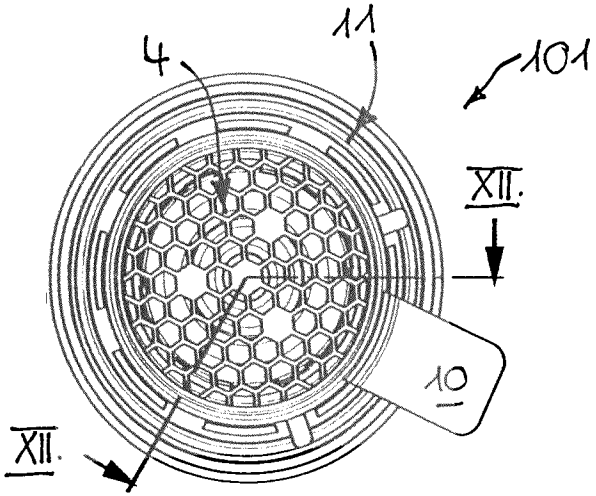
FIG. 11 shows the jet regulator from FIGS. 1 to 10 in a plan view of the outflow end side.
Figure 12:
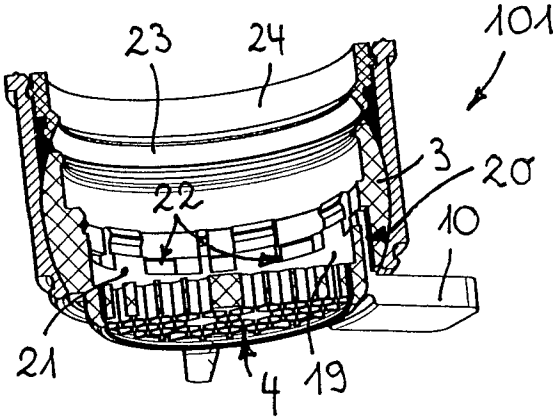
FIG. 12 shows the jet regulator from FIGS. 1 to 11 in a longitudinal section that is angled according to the dashed lines XII-XII on the jet regulator longitudinal axis in FIG. 11.
Figures 13, 14, 15, 16, 17, 18:
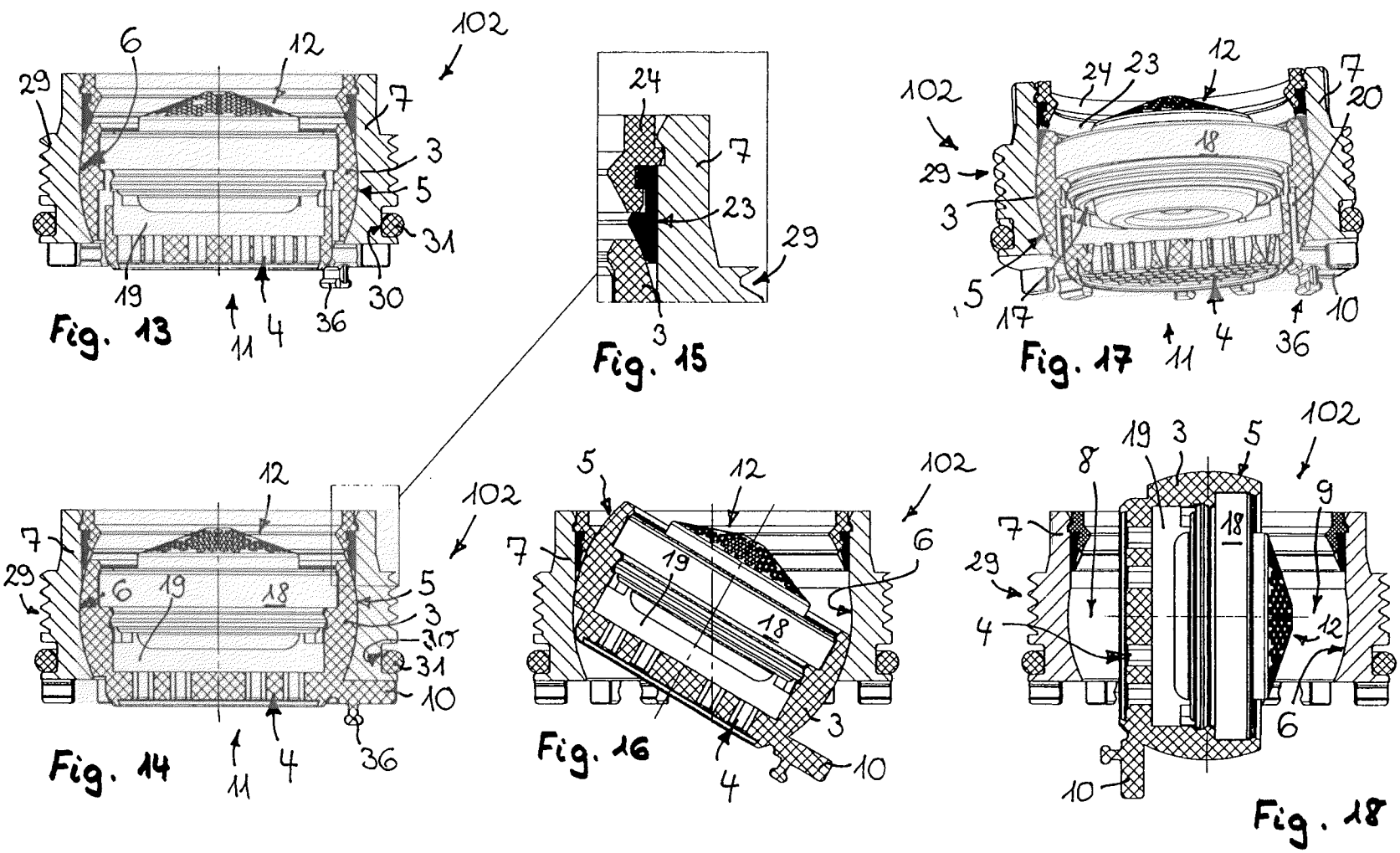
FIG. 13 shows a jet regulator in a longitudinal section, which on the housing external circumference of the jet regulator housing of said jet regulator has an external thread that is screw-fittable into an internal thread in the water outlet of a sanitary outlet fitting.
FIG. 14 shows the jet regulator from FIG. 13 in a longitudinal section, in the use position of the wall of said jet regulator.
FIG. 15 shows the jet regulator from FIGS. 13 and 14 in a detailed longitudinal section in the part-region framed in FIG. 14, in the region of a holding ring which here also secures a seal on the housing interior circumference of the jet regulator housing.
FIG. 16 shows the wall in the likewise longitudinally sectioned jet regulator housing, in a pivoted position between the use position and the cleaning position.
FIG. 17 shows the jet regulator from FIGS. 13 to 16 in a perspective longitudinal section.
FIG. 18 shows the jet regulator shown in FIGS. 13 to 17, in the cleaning position of the wall of said jet regulator.

Seven exemplary embodiments 101, 102, 103, 104, 105, 106, and 107 of a jet regulator are illustrated in FIGS. 1 to 41. As is shown in an exemplary manner in FIG. 7, the jet regulator embodiments 101, 102, 103, 104, 105, 106, and 107 are capable of being assembled on the water outlet 1 of a sanitary outlet fitting 2 so as to there shape a homogeneous and non-spraying water jet. The jet regulators 101, 102, 103, 104, 105, 106, and 107, shown here have in each case one wall 3 which supports a perforated structure 4 that forms the outlet end side of the jet regulators 101, 102, 103, 104, 105, 106, and 107. This wall 3 which here is designed as an articulating or pivoting sleeve and configured as an annular wall, by way of the spherical-layer-shaped external circumference 5 thereof is pivotably mounted in a joint socket 6 which is provided on the housing internal circumferential wall of a jet regulator housing 7. The wall 3 by way of the spherical-layer-shaped external circumference 5 thereof is mounted so as to be pivotable in the joint socket 6 in such a manner that said wall 3 in the jet regulator housing 7 is pivotable between a use position, in which the perforated structure 4 extends transversely across an outflow-side housing opening of the jet regulator housing 7, and a cleaning position, in which the water flowing through the jet regulator housing 7 can flow out of the jet regulator housing 7 through at least one opening gap 8, or 8, 9, respectively, that is/are formed between the wall 3 and the neighboring housing internal circumferential wall. Since no axle stumps which establish the pivot axis of this wall 3 in the jet regulator housing 7 are provided on the wall 3 of the jet regulators 101, 102, 103, 104, 105, 106, 107, the wall 3 can also be rotated in the circumferential direction in the joint socket 6, so as to rotate potentially distracting details such as, for example, a laterally projecting handling element, out of the field of view of the observer.

The joint socket 6 that is molded in the housing internal circumference of the jet regulator housing 7, in at least one part-region has a shape that is complementary to that of the spherical-layer-shaped external circumference 5 of the wall 3. The wall 3 by way of the spherical-layer-shaped external circumference 5 thereof is mounted in the joint socket 6 having a complementary shape so as to be rotatable in the circumferential direction and pivotable in each rotational position in the joint socket 6.

In order for the handling of the jet regulators 101, 102, 103, 104, 105, 106, 107 to be facilitated, and in order to moreover signal the pivotability of the wall 3, a handling element 10 which projects laterally beyond the circumference of the jet regulator housing 7 or beyond the outlet end side 11 of said jet regulator housing 7 is provided on the wall 3. This handling element 10 can be designed so as to be pin-shaped.

The jet regulator embodiments 101, 102, 103, 104, 105, 106, 107 illustrated here are designed as aerated jet regulators, the water flowing through being mixed with ambient air in the jet regulator housing 7 of said jet regulator embodiments. As can be readily seen in FIGS. 10, 19, 29, 39, 52, 53 to 55, and 57, the jet regulators 101, 102, 103, 104, 105, 106, and 107 have a jet splitter which splits the water flowing through into a multiplicity of individual jets. This jet splitter is inserted into the sleeve interior of the wall 3 that is designed as an articulated sleeve from the inflow side out. The jet splitter of the jet regulators 101, 102, 103, 104, 105, 106, and 107 shown here is preferably releasably connected to an attachment or filter screen 12 which is configured so as to be hat-shaped and thus remains within the envelope circle that is formed by the pivotability of the wall 3.

The jet splitter here is configured as a pot-shaped diffuser 13, or has such a pot-shaped diffuser 13, which on the pot circumference of the pot shape of said diffuser has splitter openings 14 that in the circumferential direction are uniformly spaced apart. The pot base of this pot shape forms an impact face 15 which deflects the outflowing water toward the splitter openings 14. Pin-shaped flow obstacles 16 which already split the water project herein beyond the inflow side of the pot base in the region of the splitter openings 14. The splitter openings 14 on the external side of the diffuser 13 open into an annual gap 17 which is formed between the diffuser 13 and a diffuser ring 18 that encompasses said diffuser 13. This annular gap 17 tapers in the flow direction such that the increase in velocity of the water flowing through that is caused on account of said taper, according to Bernoulli's equation, results in a vacuum on the outflow side of the annual gap 17. With the aid of said vacuum, ambient air can be suctioned into the housing interior of the jet regulator housing 7, and in particular into a mixing chamber 19 that is disposed between the jet splitter and the outflow-side perforated structure 4.

To this end, the wall 3 in the outflow-side part-region thereof has at least one aerating duct 20 that is open at the end side. The inboard wall portion that delimits the aerating duct 20 herein forms an internal wall 21 which has at least one aerating opening 22 that leads to the mixing chamber 19. The perforated structure 4 is integrally molded to the internal wall 21 on the outflow side.

The wall 3 that serves as an articulating or pivoting sleeve is insertable into the jet regulator housing 7 from the inflow side of the latter, until the wall 3 reaches the joint socket 6.

A seal 23, here configured as an annular seal, which seals between the wall 3 and the housing internal circumference of the jet regulator housing 7 is provided in the inflow-side part-region of the joint socket 6 in the case of the jet regulators 101, 102, 103, 104, 106, and 107 shown in FIGS. 1 to 41, and 53 to 57. A holding ring 24 which secures the seal 23 on the housing internal circumference of the jet regulator housing 7 engages across regions of said seal 23. The holding ring 24 herein is capable of being preferably releasably latched on the housing internal circumference of the jet regulator housing 7. The seal 23, and optionally also the holding ring 24, in the part-regions thereof that are adjacent to the joint socket 6 assume the spherical shape of the joint socket 6 and continue said shape. The seal 23 and the holding ring 24, each having an available diameter which in relation to the maximum external diameter of the wall 3 is smaller, secure the wall 3 against being forced upward counter to the flow direction of the jet regulators 101, 102, 103, 104, 106, and 107.

It can be seen from FIGS. 42 to 52 that in the case of the jet regulator 105 shown therein, at least in regions an elastic coating or layer 42 is provided between the wall 3 and the part-region of the jet regulator housing 7 that serves as a joint socket, said coating or layer 42 sealing between these component parts 3, 7 of the jet regulator 105 that are pivotable in relation to one another. It can be readily seen in FIGS. 42 to 52, and in particular in the detailed longitudinal section in FIG. 43, that the wall 3 on the external circumference thereof at least in regions supports the encircling elastic layer 42 or coating. In order for the production of the jet regulator 105 shown here to be simplified, the wall 3 that supports the layer 42 is produced as a bi-component or a multi-component plastics injection molded part.

Figure 47:
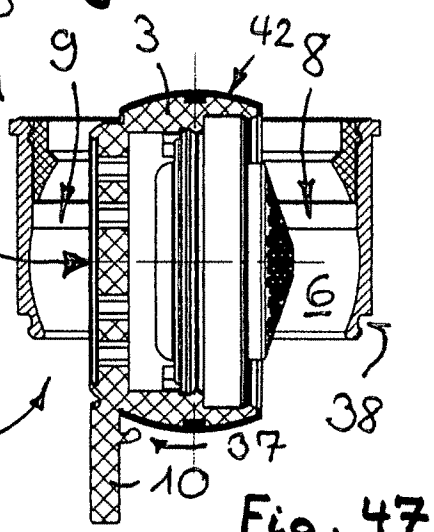
FIG. 47 shows the likewise longitudinally sectioned jet regulator from FIGS. 42 to 46 in an open position in which two opening gaps are formed between the spherical-layer-shaped wall and the housing internal circumference of the jet regulator housing.
Figure 46:
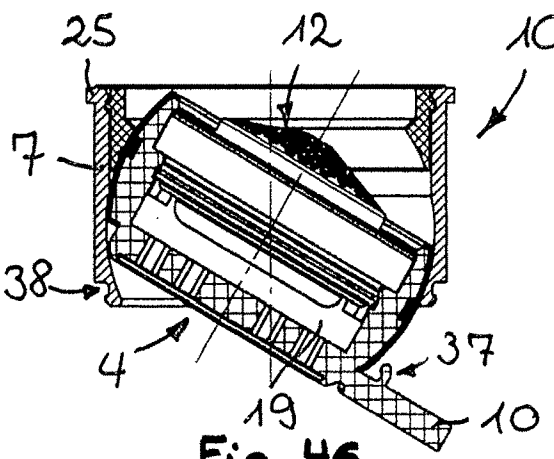
FIG. 46 shows the longitudinally sectioned jet regulator from FIGS. 42 to 45 in a further tipped position or pivoted position.
Figure 45:
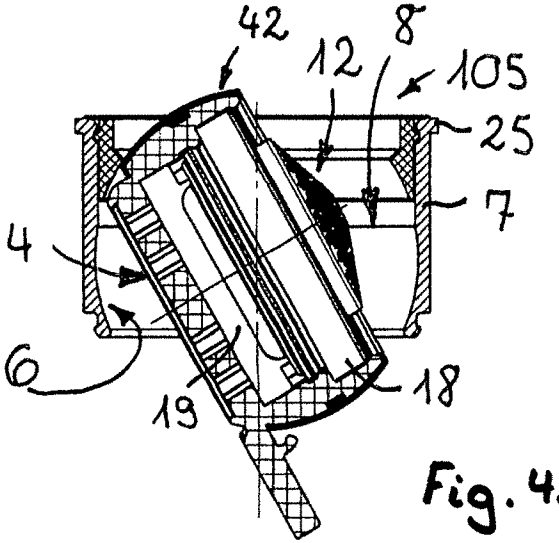
FIG. 45 shows the jet regulator from FIGS. 42 to 44 in an open or pivoted position of the wall that is pivotable in the jet regulator housing, only an opening gap being exposed in said open or pivoted position between said wall and the adjacent part-region of the jet regulator housing.

As can be seen from a comparison of FIGS. 45 and 47, the wall of the jet regulator 105 shown here can also be moved to the tilted or open position shown in FIG. 45 in a way in which the water flowing through the jet regulator housing 7 flows out of the jet regulator housing 7 through only one opening gap 8 that is formed between the wall 3 and the neighboring housing internal circumferential wall. In contrast, the wall 3 in the open position shown in FIG. 47 is additionally further pivoted or tilted in such a manner that this wall 3 is in practical terms disposed in a plane that runs through the jet regulator longitudinal axis. In the tilted position of the wall 3 of the jet regulator 105 shown in FIG. 47, the water flowing through the jet regulator housing 7 can flow out of the jet regulator housing 7 through two opening gaps 8, 9 which have been formed between the wall 3 and the respective neighboring part-region of the housing internal circumferential wall.

The jet regulators 101, 102, 103, 104, 105, 106, and 107 illustrated here are capable of being fastened wall to the water outlet 1 of a sanitary outlet fitting 2 in various ways. As becomes evident from FIGS. 1 to 12, and from FIGS. 42 to 57, a flange 25 is provided on the housing external circumference of the jet regulator housing 7 of the jet regulator 101, 105, 106, and 107. It is shown in an exemplary manner in FIGS. 7 and 53 to 57 that the jet regulators 101, 105, 106, and 107 are insertable into a sleeve-shaped outlet mouthpiece 26 that is capable of being assembled on the water outlet 1 of a sanitary outlet fitting 2, until the flange 25 bears on a contact face 27, here configured as an annular shoulder, in the outlet mouthpiece 26. In the case of the jet regulator 101 shown in FIGS. 1 to 12, the outlet mouthpiece 26 on the external circumference thereof has an external thread 28 by way of which the outlet mouthpiece 26 can be screw-fitted in an internal thread in the water outlet 1 of the sanitary outlet fitting 2. In contrast, the outlet mouthpiece 26 of the jet regulators 106 and 107 shown in FIGS. 53 to 57, on the external circumference of said outlet mouthpiece 26 has an internal thread 43 by way of which the outlet mouthpiece 26 is screw-fittable into an external thread on an adapter 44 that is connected to the water outlet 1 of the sanitary outlet fitting 2.

In contrast, the jet regulators 102, 103, and 104 are capable of being assembled in the water outlet of a sanitary outlet fitting without such an outlet mouthpiece 26. To this end, the jet regulators 102, 103, 104 on the external circumference of the jet regulator housing 7 per se thereof have an external thread 29 by way of which the jet regulator housing 7 is screw-fittable on or in an internal thread in the water outlet of the sanitary outlet fitting. The jet regulators 102 and 103 shown in FIGS. 13 to 31 can be screw-fitted in the water outlet of the sanitary outlet fitting to a depth in such a manner until the outlet end side of said jet regulators 102, 103 is disposed approximately in one plane with the outflow-side end periphery of the water outlet. Therefore, the jet regulators 102 and 103 in the use position thereof are assembled in the water outlet of the sanitary outlet fitting so as to be barely visible.

In order for the annular gap that remains between the jet regulator housing 7 and the internal circumference that delimits the water outlet to be sealed, an annular groove 30 into which an elastic annular seal 31 which forms a radial seal is placed is provided on the jet regulator housings of the jet regulators 102, 103, so as to be below the external thread 28 in the flow direction. In order for the jet regulators 102, 103 to be able to be screw-fitted in the water outlet of the outlet fitting and to be unscrewed therefrom, crown-shaped convex and concave moldings 32, 33 are provided on the outlet end side 11 of said jet regulators 102, 103, the convex moldings 32 thereof serving as a tool engagement face for a driving tool.

In order to be able to seal between the jet regulator housing 7 and the adapter 44 that is disposed upstream thereof in the inflow direction, an annular seal 45 which bears on the inflow-side end periphery of the jet regulators 106 and 107, respectively, and seals between the latter and the outflow-side circumferential periphery on the end of the adapter 44 is placed into the outlet mouthpieces 26 of the jet regulators 106 and 107. The adapter 44, below a thread that is held on the water outlet of the sanitary outlet fitting 2, has an annular groove 46 into which an annular seal 47 is likewise placed. This annular seal 47 seals the annular gap between the internal circumference of the water outlet 1 of the sanitary outlet fitting 2 and the external circumference of the adapter 44.

The jet regulator housing 7 of the jet regulator 104 shown in FIGS. 32 to 41 is configured in a manner similar to that of an outlet mouthpiece. The jet regulator housing 7 of the jet regulator 104 on the housing external circumference thereof also has an external thread 29 by way of which the jet regulator housing 7 can be screw-fitted in an internal thread in the water outlet of a sanitary outlet fitting. The jet regulator housing 7 of the jet regulator 104, in the screw-fitted use position, however by way of the major part of the jet regulator housing 7 thereof, continues to project beyond the outflow-side end periphery of the water outlet on the sanitary outlet fitting. The jet regulator housing 7 of the jet regulator 104, the former being axially sealed in relation to the water outlet by an annular seal 35 that is disposed on the inflow side, on opposite sides of the housing external circumference of said jet regulator housing 7 has wrench engagement faces 34 on which a spanner (not illustrated in more detail here) can be brought to engage, for example.

The jet regulators 101, 102, 103, 104, 105, 106, and 107 illustrated here have a handling element 10 which is molded onto the wall 3 of said jet regulators. While these handling elements 10 in the case of the jet regulators 101, 104, 105, 106, and 107 project laterally beyond the jet regulator housing 7, the handling elements 10 in the case of the jet regulators 102 and 103 are laterally recessed in relation to the external circumference of the jet regulator housing 7. Therefore, a pin 36 which projects in the longitudinal direction of the jet regulators 102, 103 and by way of which the handling element 10 of said jet regulators 102, 103 can be gripped between the fingertips is molded onto the handling elements 10 of the jet regulators 102 and 103.

In order for the wall 3 to be secured against being inadvertently pivoted as a result of the water pressure that acts from the inflow side, and in order for the wall 3 of the jet regulators 101, 102, 103, 104, 105, 106, and 107 to be held in the use position shown, for example, in FIGS. 1, 2, 5, 7, 8, 9, 12, 13, 14, 17, 20, 22, 23, 27, 30, 31, 32, 33, 37, 40, 41, 42, 44, 48, 53, 54, 55, and 57, the wall 3 in said use position is capable of being secured on the jet regulator housing 7 of the jet regulators 101, 102, 103, 104, 105, 106, 107 by a latching connection.

When viewed together, it can be seen from FIGS. 1 to 12, and 42 to 52, that this latching connection in the case of the jet regulators 101, 105 shown therein has a latching protrusion 37 that projects on the handling element 10, said latching protrusion 37 being capable of being latched on an encircling latching groove 38 on the housing external circumference of the jet regulator housing 7.

Figure 20:
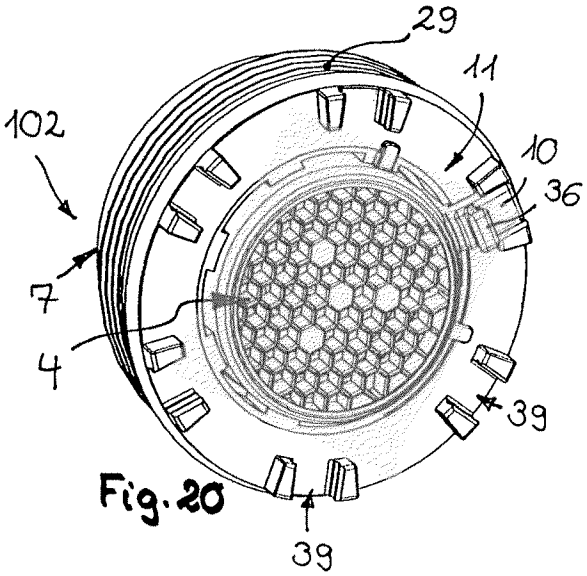
FIG. 20 shows the outlet end side of the jet regulator shown in FIGS. 13 to 19, in a perspective illustration.
Figure 21:
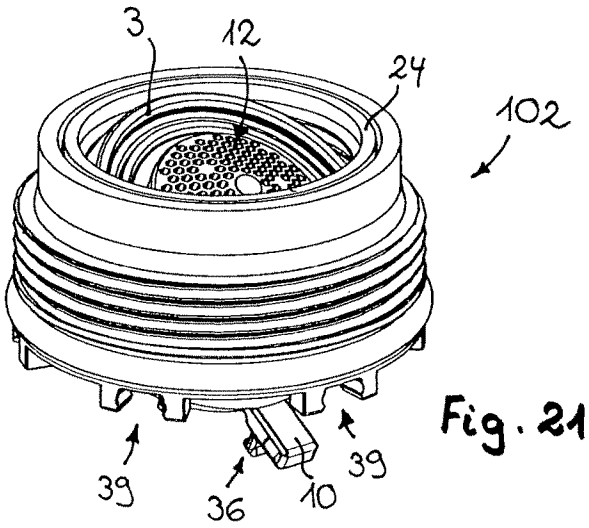
FIG. 21 shows the jet regulator from FIGS. 13 to 20 in a perspective side view, in an oblique position of the wall of said jet regulator.
Figure 19:
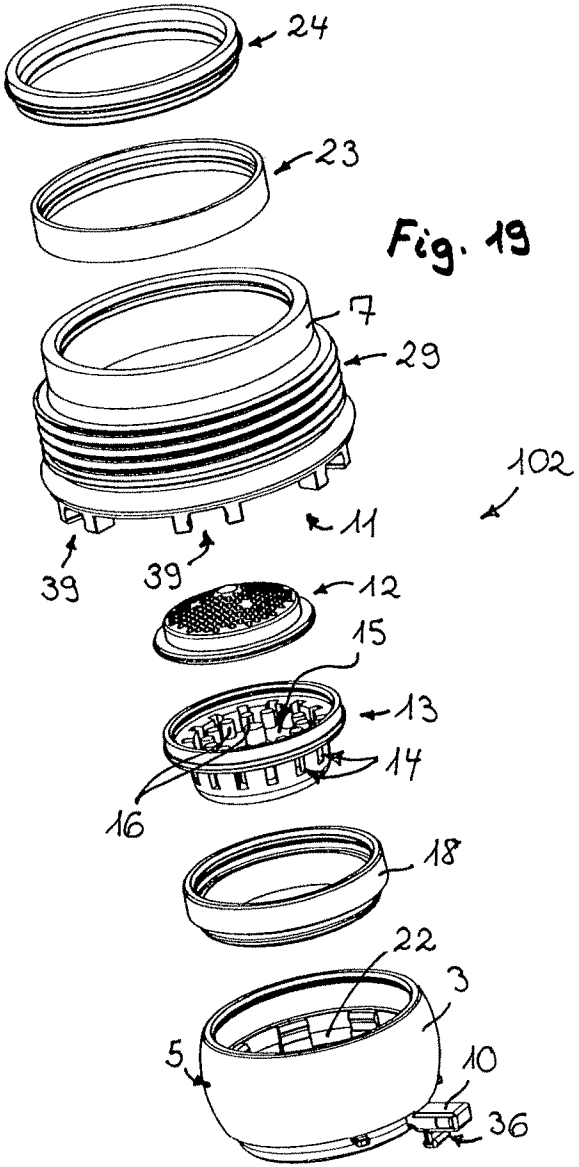
FIG. 19 shows the jet regulator from FIGS. 13 to 18 in an exploded perspective illustration of the component parts of said jet regulator.
Figure 27:
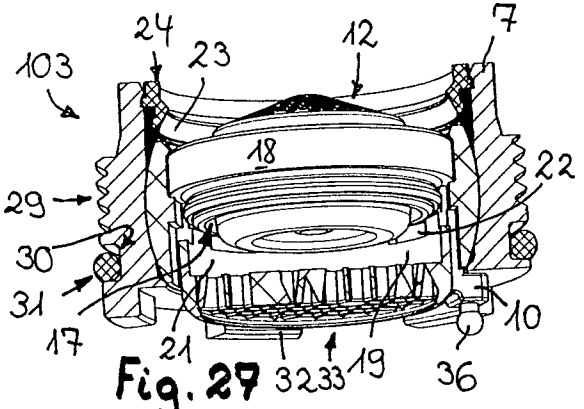
FIG. 27 shows the jet regulator from FIGS. 22 to 26 in a perspective longitudinal section.
Figure 28:
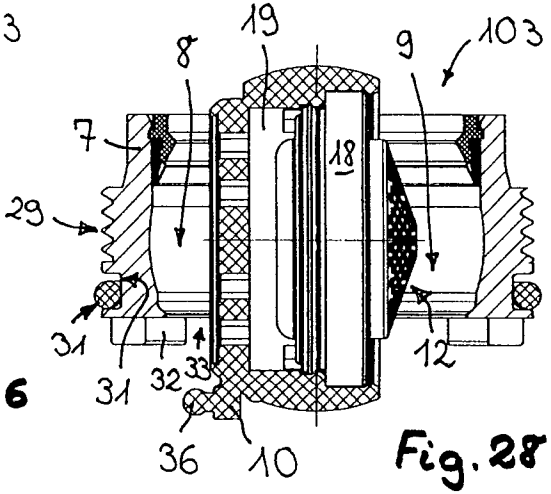
FIG. 28 shows the jet regulator from FIGS. 22 to 27 in the cleaning position of the wall of said jet regulator.
Figure 24:
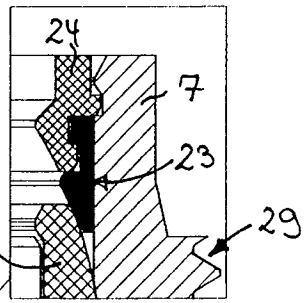
FIG. 24 shows the jet regulator from FIGS. 22 and 23 in a detailed longitudinal section in the part-region framed in FIG. 23, in the region of the holding ring that secures a seal that runs in an annular encircling manner on the housing internal circumference.
Figure 26:
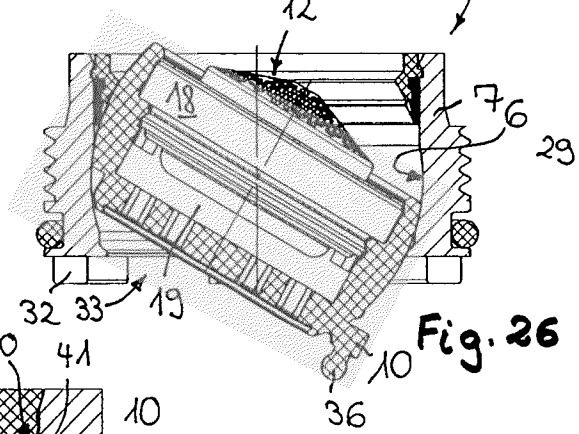
FIG. 26 shows the jet regulator from FIGS. 22 to 25 in a pivoted position which is between the use position and the cleaning position.
Figure 25:
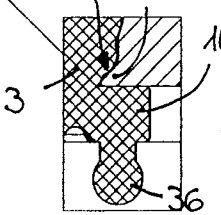
FIG. 25 shows the jet regulator from FIGS. 22 to 24 in a detailed longitudinal section in the part-region framed in FIG. 23, in the region of the latching connection between the latching lip and the concave latching molding.
Figure 22:
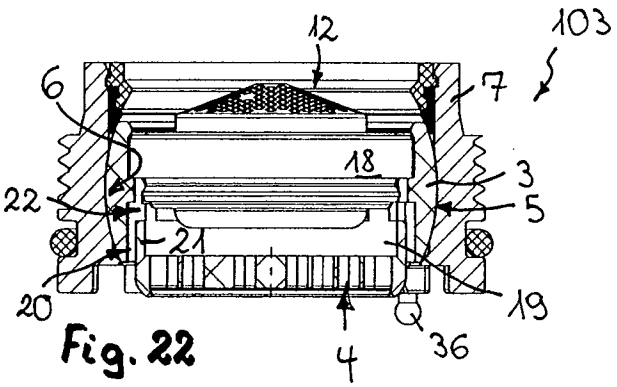
FIG. 22 shows a jet regulator shown in the longitudinal section, in which a latching lip which interacts with a concave latching molding in the region of the handling element protrudes on the outflow-side circumferential periphery of the joint socket.
Figure 23:
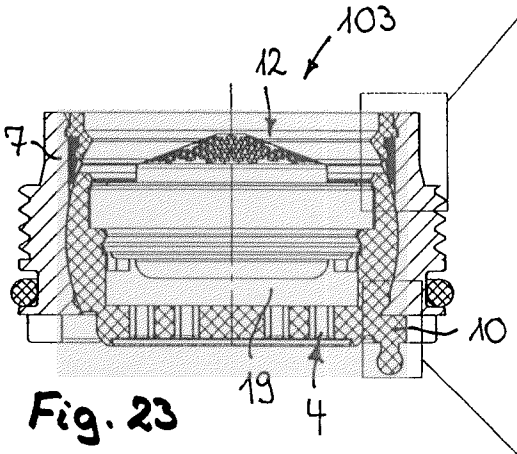
FIG. 23 shows the jet regulator from FIG. 22 in a longitudinal section, in the use position of the wall of said jet regulator.
Figure 31:
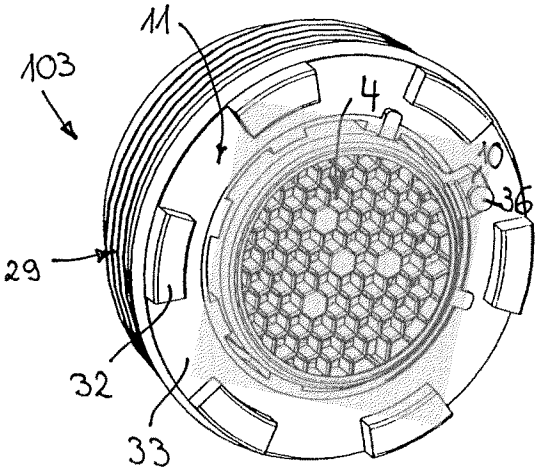
FIG. 31 shows the jet regulator from FIGS. 22 to 30 in a perspective plan view of the outlet end side.
Figure 30:
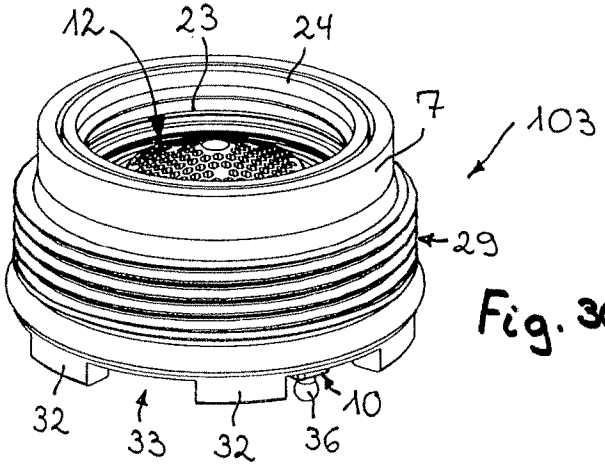
FIG. 30 shows the jet regulator shown in FIGS. 22 to 29 in a perspective plan view of the inflow-side end side of the jet regulator housing.
Figure 29:
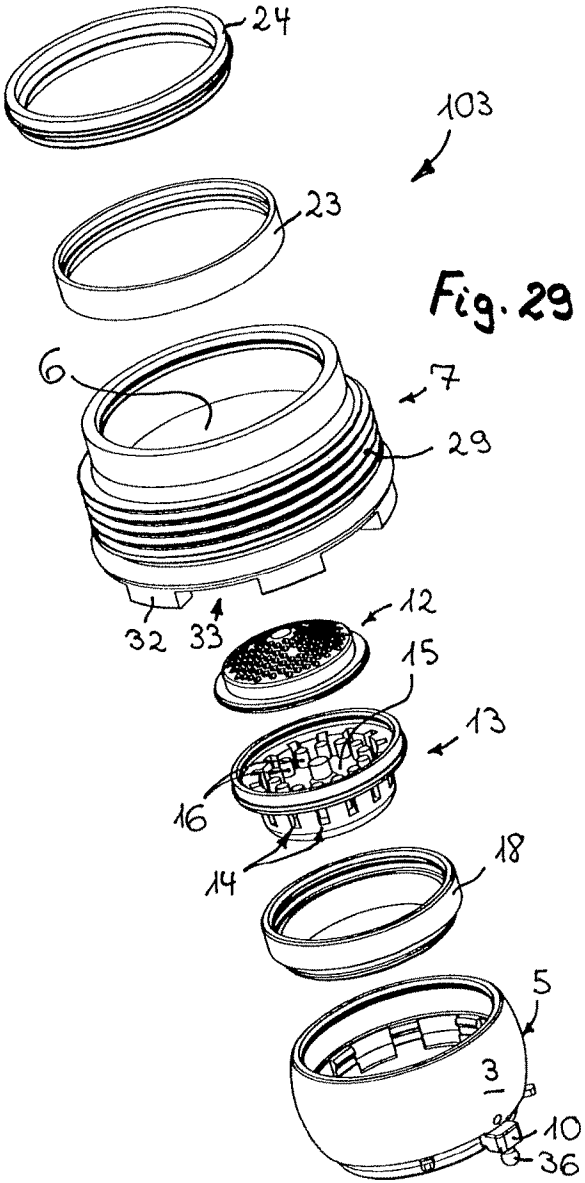
FIG. 29 shows the jet regulator from FIGS. 22 to 28 in an exploded perspective illustration of the component parts of said jet regulator.

It can be seen in FIG. 20 that the handling element 10 of the jet regulator 102 is capable of being latched on the outflow-side housing end side of the jet regulator housing. To this end, at least one latching receptacle 39 in which the handling element 10 of the jet regulator 102 is capable of being latched is provided on said outflow-side housing end side.

It becomes evident from a comparison of FIGS. 23, 25, 33, 35, and 53 to 57 that the jet regulators 103, 104, 106, and 107 in the region between the handling element 10 and the spherical-layer-shaped external circumference of the wall 3 have a concave latching molding 40 which is capable of being latched by way of an encircling latching protrusion 41 which is molded onto the jet regulator housing 7 on the outflow-side periphery of the joint socket 6.

It is a particular advantage of the jet regulators 101, 102, 103, 104, 105, 106, and 107 that the wall 3 thereof by virtue of the spherical-layer-shaped external circumference 5 thereof can be rotated to any rotational position in the joint socket 6 so as to move the handling element 10 from the field of view of a user, for example. The wall 3 herein by the latching connection is capable of being latched in any selected rotational position in such a manner that any unintentional release of the wall 3 from the use position does not have to be anticipated. In contrast, when the wall 3 is rotated in such a manner that the wall 3 is disposed so as to be approximately parallel with the jet regulator longitudinal axis, the flowing through the jet regulators 101, 102, 103, 104, 105, 106, 107 can flow through the opening gaps 8, or 8, 9, respectively, on one side or else on both sides of the wall 3 and can thus also entrain and discharge to the outside the dirt particles that have accumulated on the inflow side of the wall 3 in the region of the attachment of filter screen 12. In this way, a functionally correct operation of the jet regulators 101, 102, 103, and 104, 105, 106, and 107 is ensured even over long maintenance intervals.

As becomes evident from FIGS. 53 to 57, a first flow regulator 48 can also be integrated in the jet regulators 106 and 107 shown here. This flow regulator is intended to regulate the water volume that flows through the jet regulator 106, 107 per unit of time to an established maximum value, independently of the pressure. To this end, the flow regulator 48 is preferably releasably held on the inflow-side end side of the jet regulators 106, 107 and in turn supports the attachment or filter screen 12. Since the jet regulator 106 and 107, respectively, the inflow side upstream flow regulator 48, and the attachment or filter screen 12 form one unit which via the spherical-layer-shaped wall 3 can be pivoted between a use position and an open position, the flow regulator 48 that is connected to the jet regulator 106, 107 in the open position of the pivotable wall 3 can no longer fulfil the regulating function of said flow regulator 48. However, in many countries there are legal parameters according to which the water volume that flows out of the water outlet of a sanitary outlet fitting per unit of time must not in any case exceed a legally established maximum value. It can be advantageous in such cases for an additional second flow regulator 49 to be provided in the inflow line to the jet regulator 106, 107, preferably so as to be spaced apart from the latter in the flow direction, said additional second flow regulator 49 regulating the water volume flowing through, both in the use position as well as in the open position of the wall 3, to an established maximum value per unit of time, independently of pressure. This additional second flow regulator 49 is integrated in the sleeve-shaped adapter 44 in the case of the exemplary embodiments 106, 107 shown in FIGS. 53 to 57.

The flow regulators 48, 49 used in the exemplary embodiments according to FIGS. 53 to 57, have an annular throttle body 50 or 51, respectively which is produced from an elastic material and encompasses a central regulator core 52 or 53, respectively. A profiled regulating feature is provided on the central regulator core 52, 53 or on the circumferential wall that encompasses the elastic throttle body 50, 51, a regulating gap that is variable under the pressure of the medium flowing through being located between said profiled regulating feature and the throttle body 50, 51. As the pressure increases, the elastic throttle body 50, 51 is pressed into the profiled regulating feature, the regulating gap on account thereof being constricted in such a manner that the water volume that flows through per unit of time can be regulated to an established maximum value, independently of the pressure.

When viewed together, it becomes evident from FIGS. 53 to 56 that the flow regulator 49 that is provided in the adapter 44 has a regulator core 53 which is guided so as to be displaceable in the longitudinal or flow direction. This regulator core 53, under the pressure of the inflowing water, is moved, counter to the restoring force of a rubber-elastic or spring-elastic reset element, the latter here being configured as a compression spring 54, from the standby position shown in FIGS. 53 and 54 to the regulating position shown in FIGS. 55 and 56. Since the regulator core 53 of the flow regulator 49 in the case of minor water pressures is thus still located in the standby position thereof, in which a comparatively large annual gap still remains between the elastic throttle body 51 and the regulator core 53, even comparatively large dirt particles can still pass through the flow regulator 49 in this position, said dirt particles in the open position of the wall 3 of the jet regulator 106 being able to be subsequently discharged from the jet regulator housing. In contrast, the flow regulator 49 that is located in the adapter 44 in the case of the exemplary embodiment shown in FIG. 57 is configured as a low-pressure flow regulator such as has already been previously described in the German patent application 10 2006 057 787.6 and the parallel European patent application 07 846 729.7. This low-pressure flow regulator is distinguished by a comparatively large regulating gap which allows even comparatively large dirt particles to pass up to the jet regulator 107. Such comparatively large dirt particles can also be subsequently removed in a simple manner from the jet regulator housing 7 in the open position of the wall 3 of the jet regulator 107.

Figures 32, 33, 34, 35, 36, 37, 38:
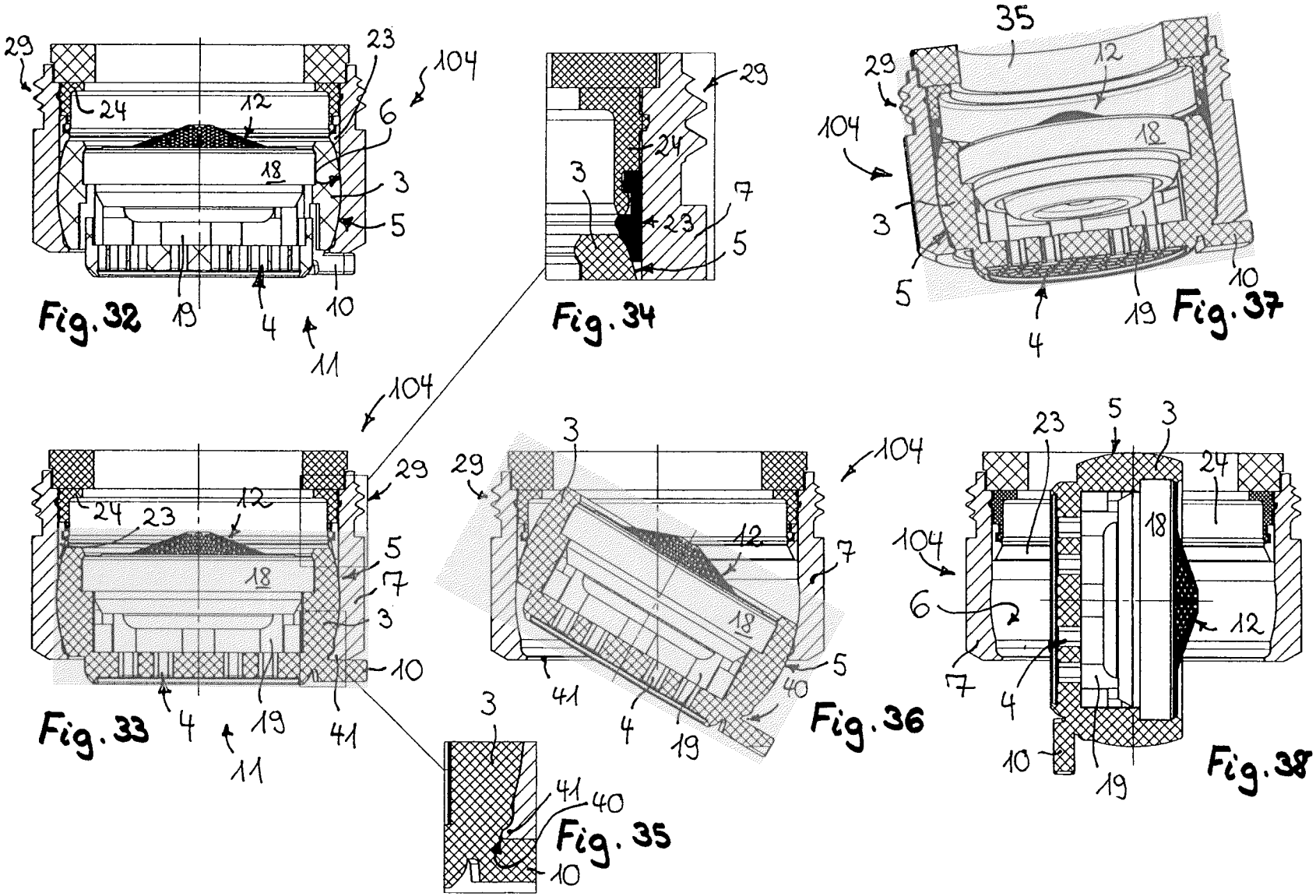
FIG. 32 shows a jet regulator in a longitudinal section, having a jet regulator housing which on the housing external circumference thereof has an external thread which is capable of being assembled in an internal thread on the water outlet of a sanitary outlet fitting.
FIG. 33 shows the jet regulator from FIG. 32 in a longitudinal section.
FIG. 34 shows the jet regulator from FIGS. 32 and 33 in a detailed longitudinal section in the part-region framed in FIG. 33, said part-region showing the holding ring that secures a seal on the housing internal circumference.
FIG. 35 shows the jet regulator shown in FIGS. 32 to 34 in a detailed longitudinal section in the region of the latching connection that is formed between a latching lip and a concave latching molding.
FIG. 36 shows the jet regulator depicted in FIGS. 32 to 35 in a pivoted position of the wall of said jet regulator, said pivoted position being located between the use position and the cleaning position.
FIG. 37 shows the jet regulator according to FIGS. 32 to 36 in a perspective longitudinal section.
FIG. 38 shows the jet regulator already depicted in FIGS. 32 to 37, in the cleaning position of the wall of said jet regulator.
Figure 41:
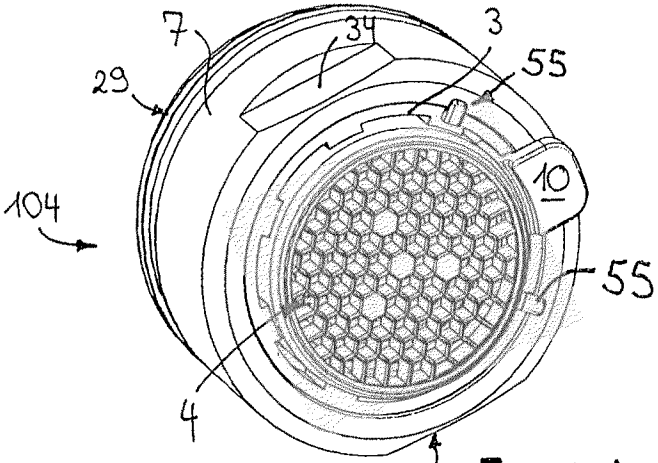
FIG. 41 shows the jet regulator from FIGS. 32 to 40 in a perspective plan view of the perforated structure of said jet regulator which forms the outlet end side of the latter.
Figure 40:
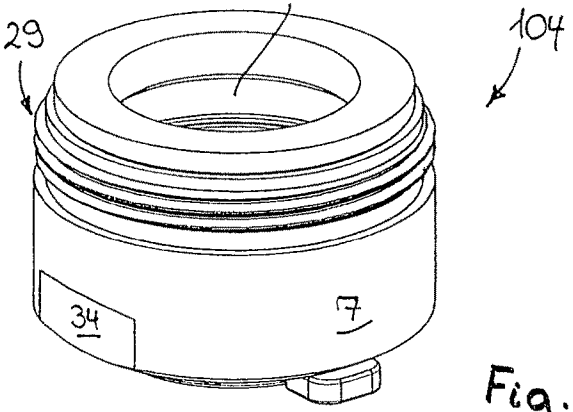
FIG. 40 shows the jet regulator from FIGS. 32 to 39 in a perspective plan view of the inflow-side end side of said jet regulator.
Figure 39:
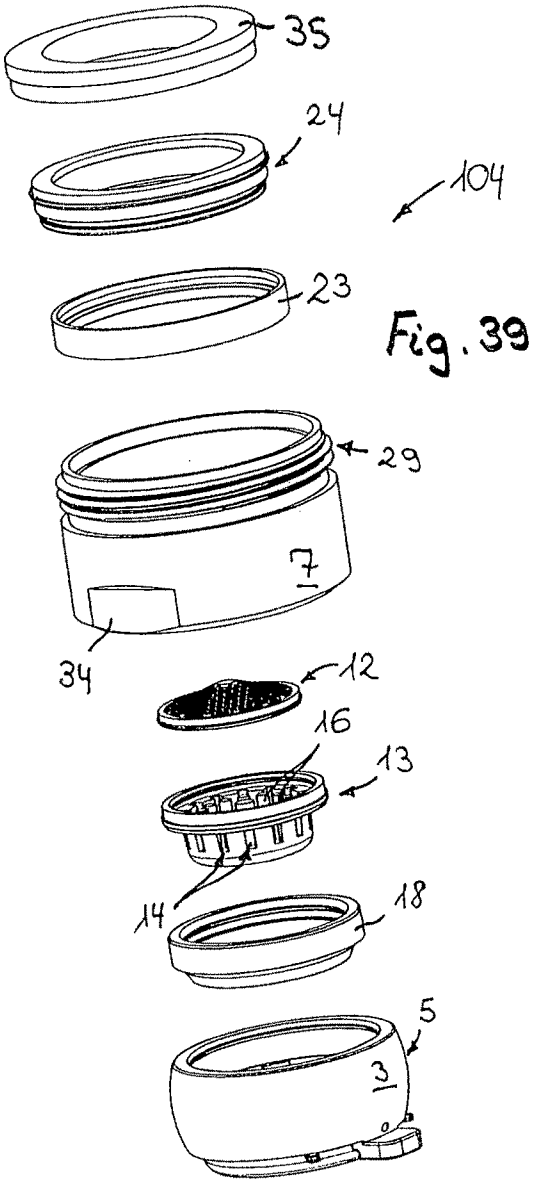
FIG. 39 shows the jet regulator from FIGS. 32 to 38 in an exploded perspective illustration of the component parts of said jet regulator.
Figure 43:
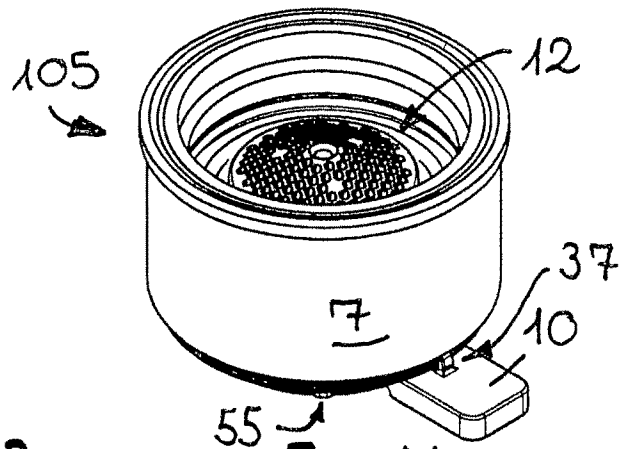
FIG. 43 shows the jet regulator from FIG. 42 in a detailed longitudinal section in the region framed in FIG. 42 between the wall and the adjacent part-region of the jet regulator housing.
Figure 42:
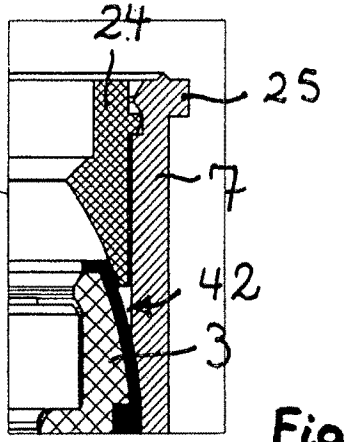
FIG. 42 shows a further embodiment of a jet regulator, shown here in the longitudinal section, in which the wall that is pivotable in the jet regulator housing on the spherical-layer-shaped external circumference of said wall supports an elastic sealing layer or coating.
Figure 44:
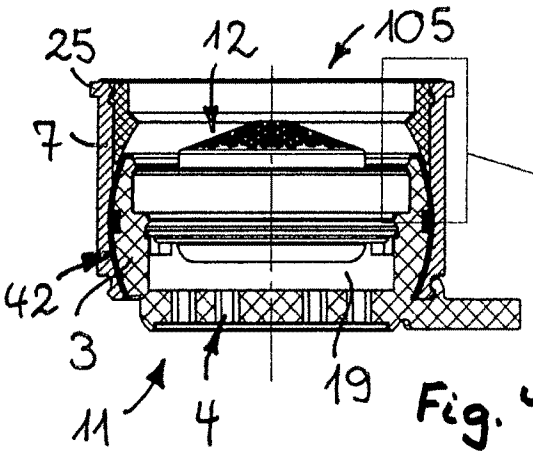
FIG. 44 shows the jet regulator from FIGS. 42 and 43 in a perspective plan view of the inflow side.
Figures 48, 49, 50, 51:
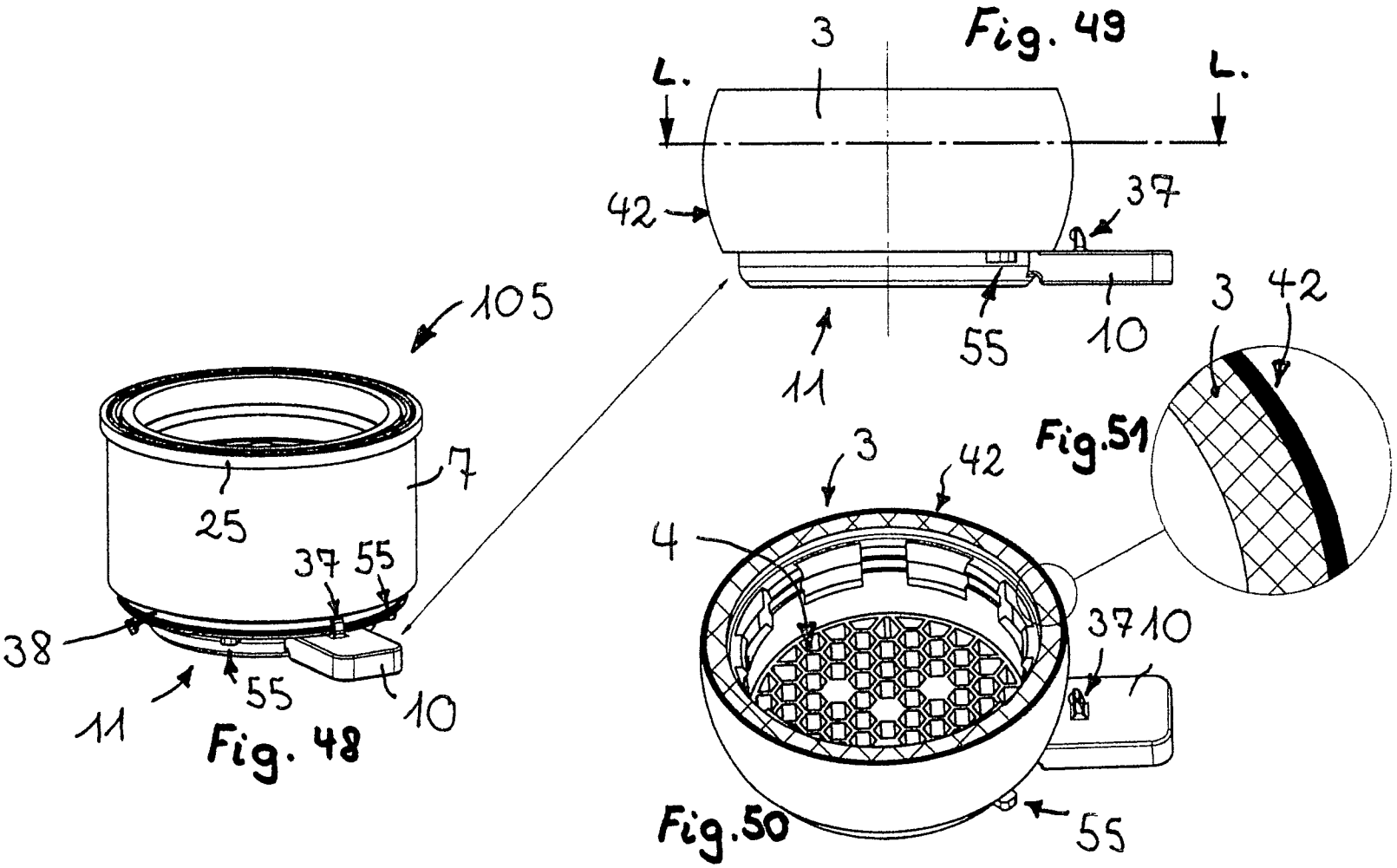
FIG. 48 shows the jet regulator from FIGS. 42 to 47 in a side view.
FIG. 49 shows the spherical-layer-shaped wall of the jet regulator already shown in FIGS. 42 to 48, said wall having been removed from the jet regulator housing.
FIG. 50 shows the wall from FIG. 49 in a cross section through the section plane L-L in FIG. 49.
FIG. 51 shows the wall from FIGS. 49 and 50 in a detailed cross section, in the part-region circled in FIG. 50.
Figure 52:
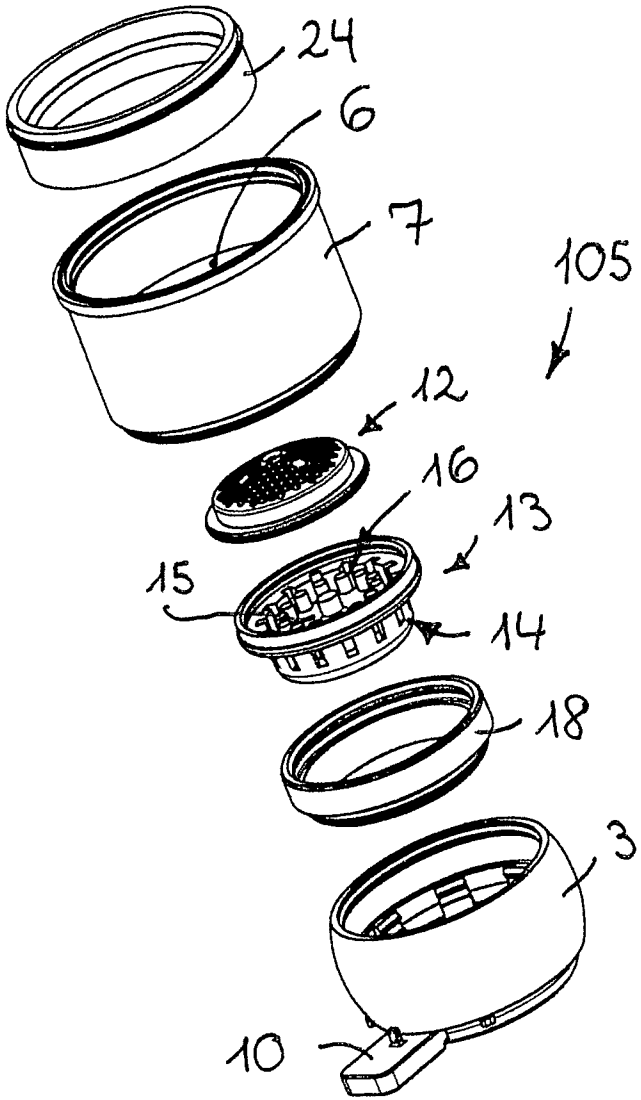
FIG. 52 shows the jet regulator from FIGS. 42 to 51 in an exploded perspective illustration of the individual component parts of said jet regulator.

It can be seen in FIGS. 37 and 49 that the jet regulator 104 is sealed in relation to the water outlet of the sanitary outlet fitting by an elastic annular seal 35.

It becomes evident from FIGS. 42 to 52 that the wall 3 of the jet regulator 105 that supports the layer 42 or coating is secured in the joint socket 6 of the jet regulator housing 7 by the holding ring 24. An additional seal 23 such as is provided, for example, in the case of the jet regulator 101, is, in contrast, not required in the case of the jet regulator 104.

When viewed together, it becomes evident from FIGS. 41, 44, and 48 to 50, that at least one alignment protrusion 55 which in the use position of the wall 3 bears on the outlet-side circumferential periphery on the end of the jet regulator housing, projects on the outlet end side of the wall 3 so as to be spaced apart from the handling element 10. In each case at least one alignment protrusion 55 is provided herein preferably on both sides of the handling element 10, said alignment protrusions 55 holding the wall 3 in a plane that is disposed so as to be approximately perpendicular to the jet regulator longitudinal axis.

LIST OF REFERENCE SIGNS

1 Water outlet
2 Sanitary outlet fitting
3 Wall
4 Perforated structure
5 Spherical-layer-shaped external circumference
6 Joint socket
7 Jet regulator housing
8 Opening gap
9 Opening gap
10 Handling element
11 Outlet end side
12 Attachment or filter screen
13 Diffusor
14 Splitter opening
15 Impact face
16 Flow obstacles
17 Annular gap
18 Diffusor ring
19 Mixing chamber
20 Aerating duct
21 Internal wall
22 Aerating opening
23 Seal
24 Holding ring
25 Flange
26 Outlet mouthpiece
27 Contact face
28 External thread
29 External thread
30 Annular groove
31 Annular seal
32 Convex molding
33 Concave molding
34 Wrench engagement face
35 Annular seal
36 Pin
37 Latching protrusion
38 Latching groove
39 Latching receptacle
40 Concave latching molding
41 Latching protrusion
42 Elastic layer or elastic coating
43 Internal thread
44 Adapter
45 Annular seal
46 Annular groove (on the adapter 44)
47 Annular seal
48 Flow regulator
49 Flow regulator
50 Throttle body (of the flow regulator 48)
51 Throttle body (of the flow regulator 49)
52 Regulator core (of the flow regulator 48)
53 Regulator core (of the flow regulator 49)
54 Reset spring
55 Alignment protrusion
101 Jet regulator (according to FIGS. 1 to 12)
102 Jet regulator (according to FIGS. 13 to 21)
103 Jet regulator (according to FIGS. 22 to 31)
104 Jet regulator (according to FIGS. 32 to 41)
105 Jet regulator (according to FIGS. 42 to 52)
106 Jet regulator (according to FIGS. 53 to 56)
107 Jet regulator (according to FIG. 57)

The invention claimed is:

1. A jet regulator (101, 102, 103, 104, 105, 106, 107) comprising:

a sleeve-shaped jet regulator housing (7) which is assemblable on a water outlet of a sanitary outlet fitting, the sleeve-shaped jet regulator housing (7) including a housing internal circumferential wall, a wall (3) which supports a perforated structure (4) that forms an outlet end side of the jet regulator (101, 102, 103, 104, 105, 106, 107) and which is pivotable in the jet regulator housing (7) between a use position, in which the perforated structure (4) extends transversely across an outflow-side housing opening of the jet regulator housing (7), and a cleaning position, in which the water flowing through the jet regulator housing (7) is adapted to flow out of the jet regulator housing (7) through at least one opening gap (8 or 9, respectively) that is formed between the wall (3) and the housing internal circumferential wall, the wall (3) has a spherical-layer-shaped external circumference (5) that is pivotably mounted in a joint socket (6) provided on the housing internal circumferential wall of the jet regulator housing (7), the wall (3) in the use position is securable on the jet regulator housing (7) by a latching connection, and the latching connection has at least one protruding latching protrusion (37; 41) on a handling element (10) that projects from the wall or on an outflow-side housing internal circumferential periphery, which is latchable in a concave latching molding (40) provided on the wall (3), or in an encircling latching groove (38) on a housing external circumference of the jet regulator housing (7) at any position around a periphery of the jet regulator housing.

2. The jet regulator as claimed in claim 1, wherein the joint socket (6) in at least one part-region has a shape that is complementary to the wall (3).

3. The jet regulator as claimed in claim 1, wherein the wall (3) is mounted to be rotatable in a circumferential direction and to be pivotable in the joint socket (6) in each rotational position.

4. The jet regulator as claimed in claim 1, wherein the handling element (10) projects beyond at least one of a circumference or an outflow end side of the jet regulator housing (7) provided on the wall (3).

5. The jet regulator as claimed in claim 4, wherein the handling element (10) is pin-shaped.

6. The jet regulator as claimed in claim 1, wherein the jet regulator (101, 102, 103, 104) is a aerated jet regulator, with water flowing through being adapted to be mixed with ambient air in the jet regulator housing (7) of said jet regulator (101, 102, 103, 104).

7. The jet regulator as claimed in claim 1, further comprising a jet splitter in the jet regulator housing which splits the water flowing through into a multiplicity of individual jets.

8. The jet regulator as claimed in claim 7, wherein the jet splitter is held in the wall (3).

9. The jet regulator as claimed in claim 7, wherein the jet splitter supports an inflow-side attachment or filter screen (12), and the attachment or filter screen (12) is hat-shaped or dish-shaped.

10. The jet regulator as claimed in claim 7, wherein the jet splitter is configured as a pot-shaped diffuser (13) or has a pot-shaped diffuser (13) which on a pot circumference thereof has splitter openings (14), a pot base (15) of said pot-shaped diffuser (13) forming an impact face which is adapted to deflect inflowing water toward the splitter openings (14).

11. The jet regulator as claimed in claim 10, wherein the splitter openings (14) open into an annular gap (17) which tapers in a flow direction.

12. The jet regulator as claimed in claim 11, wherein the annular gap (17) is provided between the diffuser (13) and a diffuser ring (18) that encompasses the diffuser (13).

13. The jet regulator as claimed in claim 6, wherein the wall (3) in an outflow-side part-region thereof has at least one aerating duct (20) that is open at an end side, and an inner wall portion that delimits the at least one aerating duct (20) forms an internal wall (21) which has at least one aerating opening (22).

14. The jet regulator as claimed in claim 1, wherein the wall (3) is insertable into the jet regulator housing (7) from an inflow side of the jet regulator housing.

15. The jet regulator as claimed in claim 1, further comprising a seal (23) which seals between the wall (3) and the housing internal circumferential wall of the jet regulator housing (7) provided in an inflow-side part-region of the joint socket (6).

16. A jet regulator (101, 102, 103, 104, 105, 106, 107) comprising:

a sleeve-shaped jet regulator housing (7) which is assemblable on a water outlet of a sanitary outlet fitting, the sleeve-shaped jet regulator housing (7) including a housing internal circumferential wall, a wall (3) which supports a perforated structure (4) that forms an outlet end side of the jet regulator (101, 102, 103, 104, 105, 106, 107) and which is pivotable in the jet regulator housing (7) between a use position, in which the perforated structure (4) extends transversely across an outflow-side housing opening of the jet regulator housing (7), and a cleaning position, in which the water flowing through the jet regulator housing (7) is adapted to flow out of the jet regulator housing (7) through at least one opening gap (8 or 9, respectively) that is formed between the wall (3) and the housing internal circumferential wall, the wall (3) has a spherical-layer-shaped external circumference (5) that is pivotably mounted in a joint socket (6) provided on the housing internal circumferential wall of the jet regulator housing (7), a seal (23) which seals between the wall (3) and the housing internal circumferential wall of the jet regulator housing (7) provided in an inflow-side part-region of the joint socket (6), and a mounting that is latchable on a housing internal circumference of the jet regulator housing (7) and which secures the annular seal (23) on the housing internal circumference of the jet regulator housing (7).

17. The jet regulator as claimed in claim 16, wherein the mounting comprises a holding ring (24) that is latchable on the housing internal circumference of the jet regulator housing (7).

18. The jet regulator as claimed in claim 1, wherein the jet regulator housing (7) on a housing external circumference thereof has a shoulder or a flange (25), and the jet regulator (101) is insertable into a sleeve-shaped outlet mouthpiece (26) that is assemblable on a water outlet (1) of a sanitary outlet fitting (2), until the shoulder or the flange (25) impacts or bears on a contact face (27) in the outlet mouthpiece (26).

19. The jet regulator as claimed in claim 1, wherein the jet regulator housing (7) includes a housing external circumference having an external thread (29), and the jet regulator housing (7) by way of said external thread (29) is screw-fittable on or in an internal thread in a water outlet of a sanitary outlet fitting.

20. The jet regulator as claimed in claim 1, further comprising at least in regions an elastic coating or layer (42) between the wall (3) and a part-region of the jet regulator housing (7) that serves as the joint socket (6), said coating or layer (42) sealing between said wall and said part-region of the jet regulator housing (3; 7) that are pivotable relative to one another.

21. The jet regulator as claimed in claim 20, wherein the wall (3) on an external circumference thereof, at least in regions, supports the elastic layer (42) or coating.

22. The jet regulator as claimed in claim 1, wherein water flowing through the jet regulator housing (7) in the cleaning position can selectively flow out through an opening gap (8) that is formed on one side on the wall (3), or through opening gaps (8, 9) that are formed on both sides of the wall (3).

23. The jet regulator as claimed in claim 1, further comprising at least one alignment protrusion (55) which in the use position of the wall (3) bears on the outflow end side of the jet regulator housing (7) projects on the outlet end side of the wall (3).

24. The jet regulator as claimed in claim 23, wherein the at least one alignment protrusion comprises at least two alignment protrusions (55) that project on the wall (3), said alignment protrusions (55) being disposed on both sides of the handling element (10) on the outflow end side of the wall (3).

25. The jet regulator as claimed in claim 1, wherein the jet regulator (106, 107) on the inflow-side end side thereof is connected to a flow regulator (48), said flow regulator (48), in a manner depending on the pressure, is adapted to regulate a water volume that flows through the jet regulator (106, 107) to an established maximum value per unit time.

26. The jet regulator as claimed in claim 25, further comprising an attachment or filter screen (12) connected to the flow regulator (48), and the flow regulator (48) is in releasably held on the jet regulator (106, 107).

27. The jet regulator as claimed in claim 1, further a flow regulator (49) which, independently of a pressure, is adapted to regulate a water volume flowing through to an established maximum value per unit time is provided in an inflow line to the jet regulator.

* * * * *